US008929786B2

(12) United States Patent
Takeuchi et al.

(10) Patent No.: US 8,929,786 B2
(45) Date of Patent: Jan. 6, 2015

(54) IMAGE FORMING APPARATUS, SYSTEM, AND METHOD USING A SUPERIMPOSED VOLTAGE SIGNAL AND A DIRECT VOLTAGE SIGNAL

(75) Inventors: Tomokazu Takeuchi, Tokyo (JP); Hiroyoshi Haga, Kanagawa (JP); Yasunobu Shimizu, Kanagawa (JP); Hiromi Ogiyama, Tokyo (JP); Kenji Sengoku, Kanagawa (JP); Junpei Fujita, Kanagawa (JP); Shinya Tanaka, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 291 days.

(21) Appl. No.: 13/526,894

(22) Filed: Jun. 19, 2012

(65) Prior Publication Data

US 2012/0328321 A1 Dec. 27, 2012

(30) Foreign Application Priority Data

Jun. 24, 2011 (JP) ..... 2011-141224
May 14, 2012 (JP) ..... 2012-110832

(51) Int. Cl.
*G03G 15/20* (2006.01)
*G03G 15/16* (2006.01)

(52) U.S. Cl.
CPC .... *G03G 15/1675* (2013.01); *G03G 2215/0129* (2013.01)
USPC ..... 399/314

(58) Field of Classification Search
USPC ..... 399/314, 66, 313, 310, 297
See application file for complete search history.

(56) References Cited

U.S. PATENT DOCUMENTS 5,179,397 A 1/1993 Ohzeki et al.
2007/0086802 A1 4/2007 Shin et al.

FOREIGN PATENT DOCUMENTS

CN 1472607 A 2/2004
EP 1 387 226 A1 2/2004
JP 2004-93735 A 3/2004
JP 2007033896 A * 2/2007
JP 2007-304492 11/2007
JP 2008-65176 3/2008

OTHER PUBLICATIONS

U.S. Appl. No. 13/477,724, filed May 22, 2012, Shimizu, et al.
U.S. Appl. No. 13/485,151, filed May 31, 2012, Shimizu, et al.
U.S. Appl. No. 13/530,555, filed Jun. 22, 2012, Takeuchi, et al.
Office Action and Search Report issued on Jun. 18, 2014 in the corresponding Chinese Patent Application No. 201210292600.0 (with English Translation).

* cited by examiner

*Primary Examiner* — Billy Lactaoen
(74) *Attorney, Agent, or Firm* — Oblon, Spivak, McClelland, Maier & Neustadt, L.L.P.

(57) ABSTRACT

An image forming apparatus includes a transfer unit configured to transfer a toner image onto a recording medium; a power supply unit configured to apply one of a superimposed voltage in which an alternating-current voltage and a first direct-current voltage are superimposed and a second direct-current voltage to the transfer unit; and a power supply control configured to, when the power supply unit outputs the superimposed voltage, instruct the power supply unit to output the first direct-current voltage at a first timing, and, when the power-supply unit outputs the second direct-current voltage, instruct the power-supply unit to output the second direct-current voltage at a second timing which is later than the first timing.

15 Claims, 16 Drawing Sheets

IMAGE FORMING APPARATUS, SYSTEM, AND METHOD USING A SUPERIMPOSED VOLTAGE SIGNAL AND A DIRECT VOLTAGE SIGNAL

CROSS-REFERENCE TO RELATED APPLICATIONS

The present application claims priority to and incorporates by reference the entire contents of Japanese Patent Application No. 2011-141224 filed in Japan on Jun. 24, 2011 and Japanese Patent Application No. 2012-110832 filed in Japan on May 14, 2012.

BACKGROUND OF THE INVENTION

1. Field of the Invention

The present invention relates to an image forming apparatus, an image forming system, and a transfer method.

2. Description of the Related Art

An image forming apparatus of an electrophotographic system forms an electrostatic latent image on a uniformly-charged image carrier, develops the formed electrostatic latent image with toner to form a toner image, and transfers and fixes the formed toner image onto a recording sheet to thereby form an image on the recording sheet.

A recording sheet usually has irregularities and toner is less easily transferred to recesses than to projections. Therefore, when an image is formed on a recording sheet having large irregularities, in some cases, toner is not transferred to recesses and density unevenness, such as white voids, occurs on an image.

Therefore, for example, Japanese Patent Application Laid-open No. 2007-304492 discloses a technology for specifying, from a difference between current values of electric currents flowing through two metal roller pairs, irregularities of a recording sheet that passes through the two metal roller pairs and adjusting a toner adhesion amount to be an adhesion amount suitable for the specified irregularities.

However, in the conventional technology described above, while the amount of toner deposited on a recording medium can be set to an amount suitable for the irregularities, a toner transfer ratio to the recording medium is not improved. Therefore, density unevenness of an image cannot be reduced.

As a method for reducing the density unevenness of an image even when the image is formed on a recording medium having irregularities, there is a method for transferring an image to a recording medium by selectively applying a direct-current voltage or a voltage based on at least an alternating-current voltage to a transfer unit depending on the degree of irregularities of the recording medium.

However, in this method, the rise time of the voltage based on at least the alternating-current voltage tends to be longer than the rise time of the direct-current voltage, and this sometimes causes density unevenness or density reduction of an image.

Therefore, there is a need for an image forming apparatus, an image forming system, and a transfer method capable of reducing density unevenness or density reduction of an image even when a voltage used for transferring an image is changed depending on a recording medium.

SUMMARY OF THE INVENTION

It is an object of the present invention to at least partially solve the problems in the conventional technology.

According to an embodiment, there is provided an image forming apparatus that includes a transfer unit configured to transfer a toner image onto a recording medium; a power supply unit configured to apply one of a superimposed voltage in which an alternating-current voltage and a first direct-current voltage are superimposed and a second direct-current voltage to the transfer unit; and a power supply control configured to, when the power supply unit outputs the superimposed voltage, instruct the power supply unit to output the first direct-current voltage at a first timing, and when the power-supply unit outputs the second direct-current voltage, instruct the power-supply unit to output the second direct-current voltage at a second timing which is later than the first timing.

According to another embodiment, there is provided an image forming system that includes an image forming apparatus including a transfer unit configured to transfer a toner image onto a recording medium, and a power supply unit configured to apply one of a superimposed voltage in which an alternating-current voltage and a first direct-current voltage are superimposed and a second direct-current voltage to the transfer unit. The image forming system also includes a power supply control unit configured to, when the power supply unit outputs the superimposed voltage, instruct the power supply unit to output at least the first direct-current voltage at a first timing, and when the power supply unit outputs the second direct-current voltage, instruct the power supply unit to output the second direct-current voltage at a second timing which is later than the first timing.

According to still another embodiment, there is provided a transfer method that includes transferring, by a transfer unit, a toner image onto a recording medium; applying, by a power supply unit, one of a superimposed voltage in which an alternating-current voltage and a first direct-current voltage are superimposed and a second direct-current voltage to the transfer unit; instructing, by a power supply control unit, the power supply unit to start outputting at least the first direct-current voltage at a first timing when the superimposed voltage is output at the applying; and instructing, by the power supply control unit, the power supply unit to start outputting the second direct-current voltage at a second timing which is later than the first timing when the second direct-current voltage is output at the applying.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained in detail below with reference to the accompanying drawings. In an example explained in the embodiments, an image forming apparatus according to the embodiments is applied to a color printing apparatus of an electrophotographic system and is applied particularly to a printing apparatus that superimposes color component images of four colors of yellow (Y), magenta (M), cyan (C), and black (K) one top of another on a recording sheet to form an image. However, the image forming apparatus is not limited to this example. The image forming apparatus according to the embodiments can be applied to any apparatus that forms an image in the electrophotographic system irrespective of whether the apparatus is a color apparatus or a monochrome apparatus. For example, the image forming apparatus according to the embodiments can be applied to a copying machine or a multifunction peripheral (MFP) of the electrophotographic system. The multifunction peripheral is an apparatus including at least two functions among a printing function, a copying function, a scanner function, and a facsimile function.

First Embodiment

The configuration of a printing apparatus according to a first embodiment will be explained below.

Figure 1:
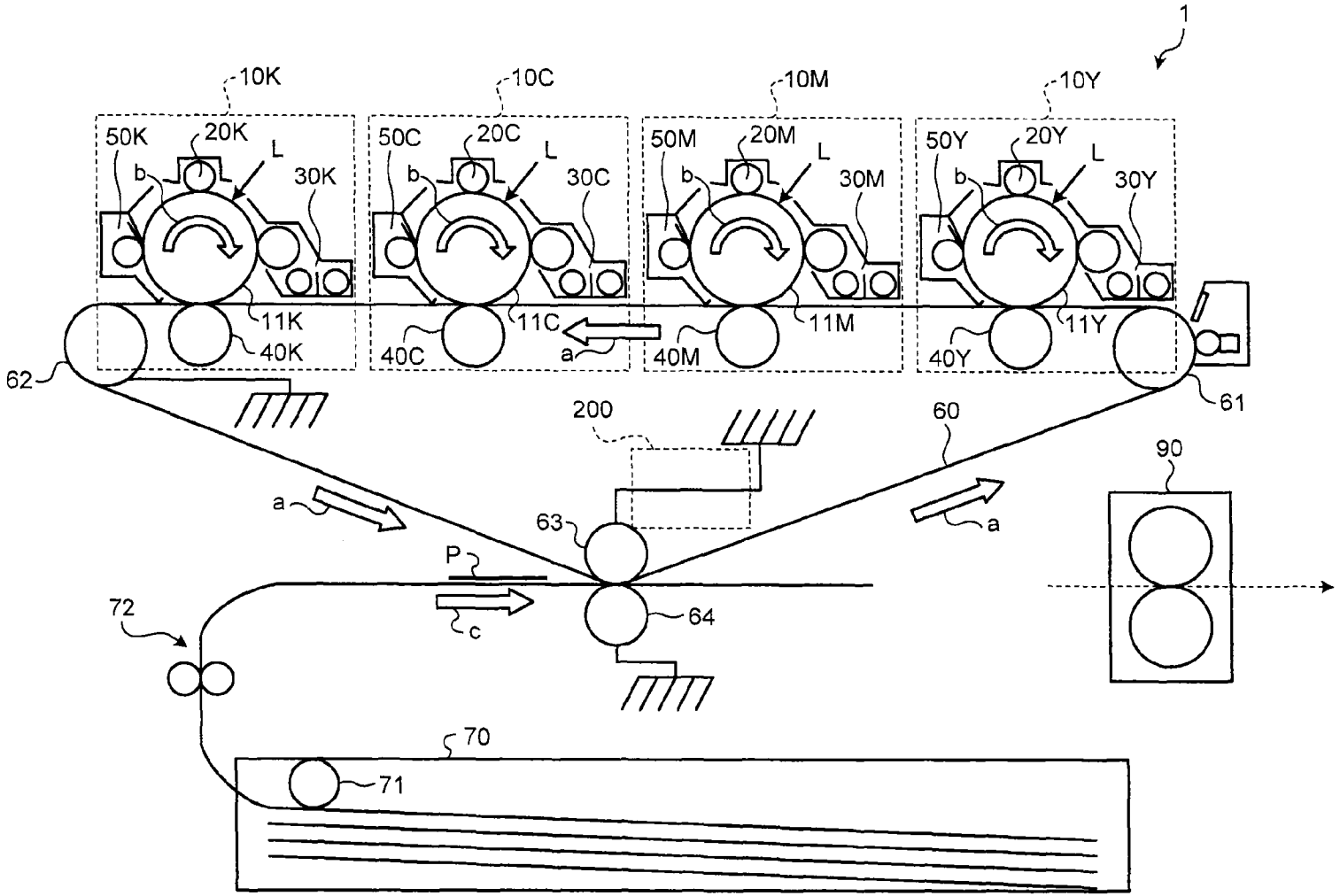
FIG. 1 is a functional configuration diagram of an example of a printing apparatus according to a first embodiment.

FIG. 1 is a functional configuration diagram of an example of a printing apparatus 1 according to the first embodiment. As illustrated in FIG. 1, the printing apparatus 1 includes image forming units 10Y, 10M, 10C, and 10K, an intermediate transfer belt 60, supporting rollers 61 and 62, a secondary-transfer-unit opposed roller (repulsive roller) 63, a secondary transfer roller 64, a sheet cassette 70, a sheet feed roller 71, a conveying roller pair 72, a fixing unit 90, and a secondary transfer power supply 200.

As illustrated in FIG. 1, the image forming units 10Y, 10M, 10C, and 10K are arranged along the intermediate transfer belt 60 in the order of the image forming units 10Y, 10M, 10C, and 10K from an upstream side in a moving direction of the intermediate transfer belt 60 (an arrow "a" direction).

Figure 2:
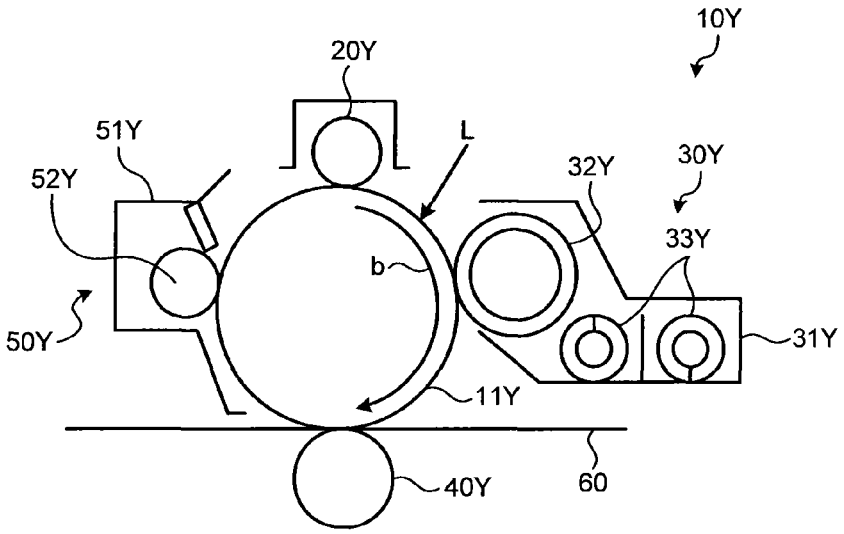
FIG. 2 is a functional configuration diagram of an example of an image forming unit according to the first embodiment.

FIG. 2 is a functional configuration diagram of an example of the image forming unit 10Y according to the first embodiment. As illustrated in FIG. 2, the image forming unit 10Y includes a photosensitive drum 11Y, a charging unit 20Y, a developing unit 30Y, a primary transfer roller 40Y, and a cleaning unit 50Y. The image forming unit 10Y and a not-shown irradiation unit perform an image forming process (a charging step, an irradiating step, a developing step, a transfer step, and a cleaning step) on the photosensitive drum 11Y to thereby form a toner image (a color component image) of yellow on the photosensitive drum 11Y and transfers the toner image onto the intermediate transfer belt 60.

All the image forming units 10M, 10C, and 10K include components common to the image forming unit 10Y. The image forming unit 10M performs the image forming process to form a toner image of magenta. The image forming unit 10C performs the image forming process to form a toner image of cyan. The image forming unit 10K performs the image forming process to form a toner image of black. Therefore, the components of the image forming unit 10Y are mainly explained below. Concerning the components of the image forming units 10M, 10C, and 10K, M, C, and K are affixed to reference numerals and signs instead of Y affixed to the reference numerals and signs of the components of the image forming unit 10Y (see FIG. 1), and explanation of the components of the image forming units 10M, 10C, and 10K is omitted.

The photosensitive drum 11Y is an image carrier and is driven to rotate in an arrow "b" direction by a not-shown photosensitive-drum driving device. The photosensitive drum 11Y is, for example, an organic photosensitive member having an outer diameter of 60 millimeters. The photosensitive drums 11M, 11C, and 11K are also driven to rotate in the arrow "b" direction by the not-shown photosensitive-drum driving device.

The photosensitive drum 11K for black and the photosensitive drums 11Y, 11M, and 11C for colors may be driven to rotate independently from each other. This makes it possible to rotate only the photosensitive drum 11K for black when a monochrome image is formed and simultaneously rotate the photosensitive drums 11Y, 11M, 11C, and 11K when a color image is formed.

First, in the charging step, the charging unit 20Y charges the surface of the photosensitive drum 11Y being rotated. Specifically, the charging unit 20Y applies a voltage obtained by superimposing an alternating-current voltage on a direct-current voltage to a charging roller (not illustrated), which is, for example, a conductive elastic member having a roller shape. Consequently, the charging unit 20Y directly causes electrical discharge between the charging roller and the photosensitive drum 11Y and charges the photosensitive drum 11Y to a predetermined polarity, for example, a minus polarity.

Subsequently, in the irradiating step, the not-shown irradiation unit irradiates the charged surface of the photosensitive drum 11Y with an optically-modulated laser beam L to form an electrostatic latent image on the surface of the photosensitive drum 11Y. As a result, a portion where the absolute value of a potential falls on the surface of the photosensitive drum 11Y because of irradiation with the laser beam L becomes an electrostatic latent image (an image section), and a portion where the laser beam L is not applied and the absolute value of a potential is kept high becomes a background section.

Subsequently, in the developing step, the developing unit 30Y develops the electrostatic latent image formed on the photosensitive drum 11Y with yellow toner and forms a yellow toner image on the photosensitive drum 11Y.

The developing unit 30Y includes a storage container 31Y, a developing sleeve 32Y housed in the storage container 31Y, and screw members 33Y housed in the storage container 31Y. In the storage container 31Y, two-component developer including yellow toner and carrier particles is stored. The developing sleeve 32Y is a developer carrier and is arranged opposite the photosensitive drum 11Y across an opening of the storage container 31Y. The screw members 33Y are agitating members that convey the developer while agitating the developer. The screw members 33Y are arranged on a supply side of the developer, which is the developing sleeve side, and a receiving side where the developer is received from a not-shown toner supply device. The screw members 33Y are rotatably supported in the storage container 31Y by not-shown bearing members.

Subsequently, in the transfer step, the primary transfer roller 40Y transfers the yellow toner image formed on the photosensitive drum 11Y onto the intermediate transfer belt 60. A small amount of non-transferred toner remains on the photosensitive drum 11Y even after the transfer of the toner image.

The primary transfer roller 40Y is, for example, an elastic roller including a conductive sponge layer and is arranged so as to be pressed against the photosensitive drum 11Y from the back surface of the intermediate transfer belt 60. A bias subjected to constant current control is applied to the elastic roller as a primary transfer bias. The primary transfer roller 40Y has, for example, an outer diameter of 16 millimeters and a core bar diameter of 10 millimeters. The value of resistance R of the sponge layer in the primary transfer roller 40Y is about $3\times10^7$ ohms. The value of the resistance R of the sponge layer is a value which is calculated by using the Ohm's law (R=V/I) from an electric current I that flows when a voltage V of 1000 volts is applied to the core bar of the primary transfer roller 40Y while a grounded metal roller having an outer diameter of 30 millimeters is pressed against the primary transfer roller 40Y at 10 newtons.

Subsequently, in the cleaning step, the cleaning unit 50Y wipes out the non-transferred toner remaining on the photosensitive drum 11Y. The cleaning unit 50Y includes a cleaning blade 51Y and a cleaning brush 52Y. The cleaning blade 51Y cleans the surface of the photosensitive drum 11Y in a state in which the cleaning blade 51Y is in contact with the photosensitive drum 11Y in a counter direction with respect to a rotating direction of the photosensitive drum 11Y. The cleaning brush 52Y cleans the surface of the photosensitive drum 11Y in a state in which the cleaning brush 52Y is in contact with the photosensitive drum 11Y while rotating in the opposite direction of the rotating direction of the photosensitive drum 11Y.

Referring back to FIG. 1, the intermediate transfer belt 60 is an endless belt wound around a plurality of rollers such as the supporting rollers 61 and 62 and the secondary-transfer-unit opposed roller 63. When one of the supporting rollers 61 and 62 is driven to rotate, the intermediate transfer belt 60 moves in the arrow "a" direction. On the intermediate transfer belt 60, the yellow toner image is first transferred by the image forming unit 10Y, and thereafter, the magenta toner image, the cyan toner image, and the black toner image are sequentially transferred by the image forming unit 10M, the image forming unit 10C, and the image forming unit 10K, respectively, in a superimposed manner. Consequently, a full-color toner image (a full-color image) is formed on the intermediate transfer belt 60. The intermediate transfer belt 60 conveys the formed full-color image to between the secondary-transfer-unit opposed roller 63 and the secondary transfer roller 64. The intermediate transfer belt 60 is formed of, for example, endless carbon dispersed polyimide resin having thickness of 20 micrometers to 200 micrometers (preferably, about 60 micrometers), volume resistivity of 6.0 Log to 13.0 Log Ω·cm (preferably, 7.5Log to 12.5Log Ω·cm, and more preferably, about 9 Log Ω·cm), and surface resistivity of 9.0 Log to 13.0 Log Ω·cm (preferably, 10.0 Log to 12.0 Log Ω·cm). The volume resistivity is a measured resistance value measured under conditions of 100 volts and 10 seconds with Hiresta HRS Probe manufactured by Mitsubishi Chemical Corporation, and the surface resistivity is a measured resistance value measured under conditions of 500 volts and 10 seconds with Hiresta HRS Probe manufactured by Mitsubishi Chemical Corporation. The supporting roller 62 is grounded.

In the sheet cassette 70, a plurality of recording sheets are stored in not-shown trays in a stacked manner. Recording sheets of different types and sizes are stored in different trays. In the first embodiment, the recording sheet (an example of a recording medium) is assumed as leathac paper having large irregularities; however, the recording sheet is not limited to the leathac paper.

The sheet feed roller 71 is in contact with a recording sheet P located at the top of recording sheets in the sheet cassette 70 and feeds the recording sheet P being in contact with the sheet feed roller 71.

The conveying roller pair 72 conveys the recording sheet P, which is fed by the sheet feed roller 71, to between the secondary-transfer-unit opposed roller 63 and the secondary transfer roller 64 (in an arrow "c" direction) at a predetermined timing.

The secondary-transfer-unit opposed roller 63 and the secondary transfer roller 64 collectively transfer the full-color toner image conveyed by the intermediate transfer belt 60 onto the recording sheet P conveyed by the conveying roller pair 72, at a secondary transfer nip (not illustrated) formed between the secondary-transfer-unit opposed roller 63 and the secondary transfer roller 64.

The secondary-transfer-unit opposed roller 63 (an example of a transfer unit) is, for example, a conductive NBR rubber layer having an outer diameter of 24 millimeters and a core bar diameter of 16 millimeters. The value of resistance R of the conductive NBR rubber layer is 6.0Log to 12.0 Log ohms (or stainless steel (SUS)), and preferably, 4.0 Log ohms. The secondary transfer roller 64 is, for example, a conductive NBR rubber layer having an outer diameter of 24 millimeters and a core bar diameter of 14 millimeters. The value of resistance R of the conductive NBR rubber layer is 6.0 Log to 8.0 Log ohms, and preferably, 7.0 Log to 8.0 Log ohms. Volume resistance of the secondary transfer roller 64 is a measured resistance value measured by using cyclometry such that rotation resistance of the roller is measured during a measurement time of 1 minute under conditions of one-sided load of 5 newtons and bias application of 1 kilovolt to a transfer roller shaft, and an average is obtained as the volume resistance.

The secondary transfer power supply 200 for transfer bias is connected to the secondary-transfer-unit opposed roller 63. The secondary transfer power supply 200 (an example of a power supply unit) applies a voltage to the secondary-transfer-unit opposed roller 63 in order to transfer the full-color toner image onto the recording sheet P at the secondary transfer nip. Specifically, the secondary transfer power supply 200 applies only a direct-current voltage (an example of a second direct-current voltage, hereinafter, described as a "DC bias") to the secondary-transfer-unit opposed roller 63 or applies a superimposed voltage obtained by superimposing a direct-current voltage (an example of a first direct-current voltage) and an alternating-current voltage (hereinafter, the superimposed voltage is described as a "superimposed bias") to the secondary-transfer-unit opposed roller 63 in accordance with a setting set by a user. Consequently, a potential difference occurs between the secondary-transfer-unit opposed roller 63 and the secondary transfer roller 64 and a voltage for directing toner from the intermediate transfer belt 60 to the recording sheet P side is generated. Therefore, the full-color toner image can be transferred onto the recording sheet P. The potential difference in the first embodiment is assumed as (the potential of the secondary-transfer-unit opposed roller 63)−(the potential of the secondary transfer roller 64).

The fixing unit 90 heats and presses the recording sheet P having the full-color toner image transferred thereon to thereby fix the full-color toner image on the recording sheet P. The recording sheet P with the fixed full-color toner image is discharged to the outside of the printing apparatus 1.

Figure 3:
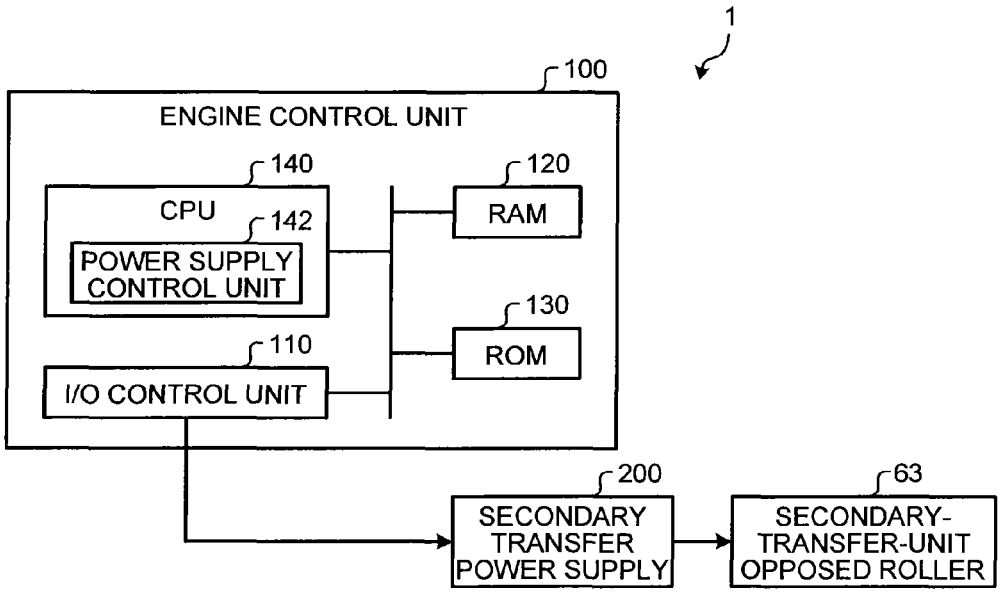
FIG. 3 is a block diagram of an example of an electrical configuration of the printing apparatus according to the first embodiment.

FIG. 3 is a block diagram of an example of an electrical configuration of the printing apparatus 1 according to the first embodiment. As illustrated in FIG. 3, the printing apparatus 1 includes an engine control unit 100, the secondary transfer power supply 200, and the secondary-transfer-unit opposed roller 63.

The engine control unit 100 performs engine control, for example, control related to image formation, and includes an I/O control unit 110, a random access memory (RAM) 120, a read only memory (ROM) 130, and a central processing unit (CPU) 140.

The I/O control unit 110 controls input and output of various signals and specifically controls input and output of signals exchanged with the secondary transfer power supply 200.

The RAM 120 is a volatile storage device (memory) and is used as a work area by the CPU 140 or the like.

The ROM 130 is a nonvolatile read-only storage device (memory) and stores therein various programs executed by the printing apparatus 1 or data used for various processes executed by the printing apparatus 1. For example, the ROM 130 stores therein designation information for designating a first timing, which is a timing at which a DC-bias output signal and an AC-bias output signal are output to the secondary transfer power supply 200 when the secondary transfer power supply 200 performs a high-voltage output at the superimposed bias. The designation information designates the first timing based on, for example, a print start reference signal indicating a print start criterion. The ROM 130 also stores therein interval information that indicates an interval between the first timing and a second timing that is a timing at which a DC-bias output signal is output to the secondary transfer power supply 200 when the secondary transfer power supply 200 performs the high-voltage output at only the DC bias.

Figure 4:
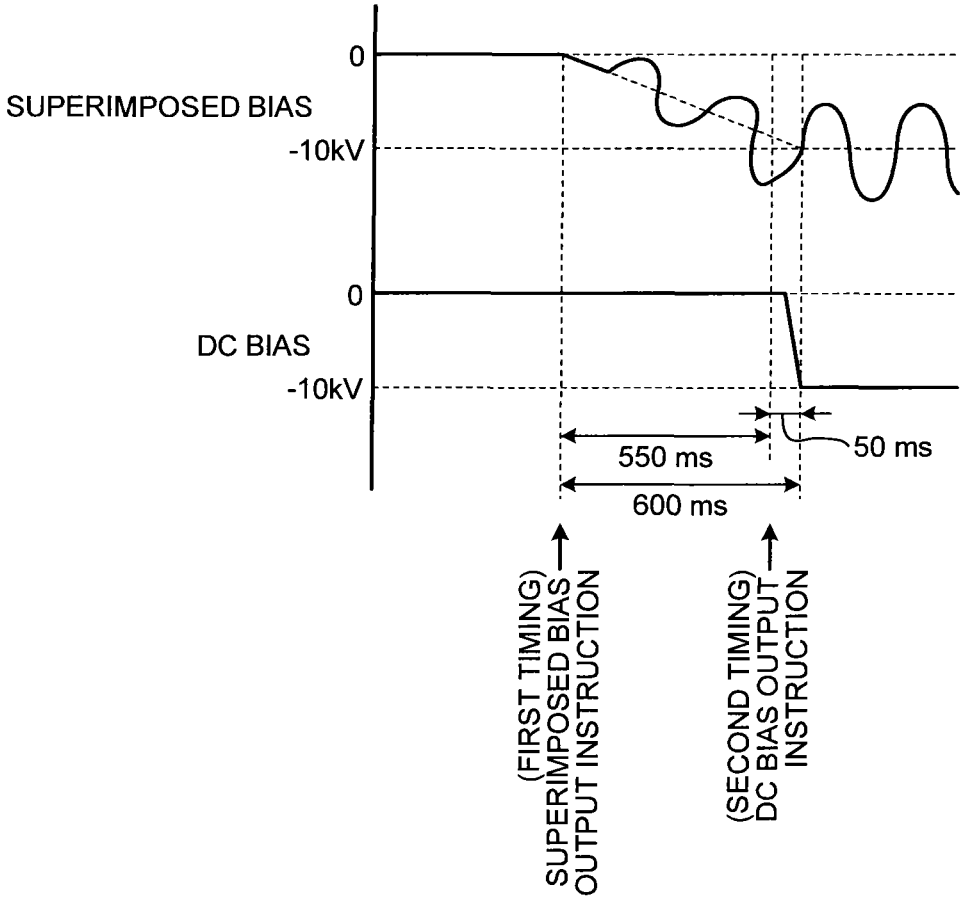
FIG. 4 is a diagram for explaining an example of the rise timing of a high-voltage output at a superimposed bias and a high-voltage output at a DC bias according to the first embodiment.

The first timing and the second timing will be explained below. FIG. 4 is a diagram for explaining an example of the rise timing of the high-voltage output at the superimposed bias and the rise timing of the high-voltage output at the DC bias. The rise means that a state in which there is no potential difference (0 kilovolts) is changed to a state in which a potential difference occurs irrespective of whether the potential difference is positive or negative. As illustrated in FIG. 4, when the secondary transfer power supply 200 performs the high-voltage output at only the DC bias, it takes 50 milliseconds from when a DC-bias output instruction is issued to the secondary transfer power supply 200 (a DC-bias output signal is output to the secondary transfer power supply 200) to when the bias value of the secondary transfer power supply 200 reaches a target value (−10 kilovolts). On the other hand, when the secondary transfer power supply 200 performs the high-voltage output at the superimposed bias, it takes 600 milliseconds from when a superimposed-bias output instruction is issued to the secondary transfer power supply 200 (a DC-bias output signal and an AC-bias output signal are output to the secondary transfer power supply 200) to when the bias value of the secondary transfer power supply 200 reaches the target value (−10 kilovolts).

In this way, when the secondary transfer power supply 200 performs the high-voltage output at the superimposed bias, an alternating current (AC) is superimposed on a direct current (DC) having a large bias output value. Therefore, compared with the case that the high-voltage output is performed at only the DC bias, a longer time is needed before the bias value reaches the target value (before the voltage rises).

Therefore, in the first embodiment, it is assumed that the first timing is a timing at which the superimposed-bias output instruction is issued to the secondary transfer power supply 200 (the DC-bias output signal and the AC-bias output signal are output to the secondary transfer power supply 200) when the secondary transfer power supply 200 performs the high-voltage output at the superimposed bias. The designation information designates the first timing based on an elapsed time since reception of the print start reference signal (not illustrated) by the CPU 140. Furthermore, in the first embodiment, it is assumed that the second timing is a timing at which the DC-bias output instruction is issued to the secondary transfer power supply 200 (the DC-bias output signal is output to the secondary transfer power supply 200) when the secondary transfer power supply 200 performs the high-voltage output at only the DC bias. The interval information specifies the second timing based on an interval from the first timing. Therefore, in the first embodiment, the interval indicated by the interval information is 550 milliseconds. When the secondary transfer power supply 200 performs the high-voltage output at the superimposed bias, the output instruction is issued to the secondary transfer power supply 200 550 milliseconds earlier compared with the case that the secondary transfer power supply 200 performs the high-voltage output at only the DC bias.

Referring back to FIG. 3, the CPU 140 receives the print start reference signal or receives a setting on a high-voltage output from a user through an operating unit, such as an operation panel (not illustrated). For example, when the recording sheet is leathac paper having large irregularities, the user inputs "high-voltage output at a superimposed bias" as a user setting on the high-voltage output through the operating unit. When the recording sheet is normal paper, the user inputs "high-voltage output at only a DC bias" as the user setting on the high-voltage output through the operating unit. The CPU 140 causes the secondary transfer power supply 200 to perform a high-voltage output according to the user setting via the I/O control unit 110. The CPU 140 includes a power supply control unit 142.

When the user setting is "high-voltage output at a superimposed bias", that is, when the secondary transfer power supply 200 performs a high-voltage output at the superimposed voltage, the power supply control unit 142 instructs the secondary transfer power supply 200 to perform the high-voltage output at the first timing.

Figure 5:
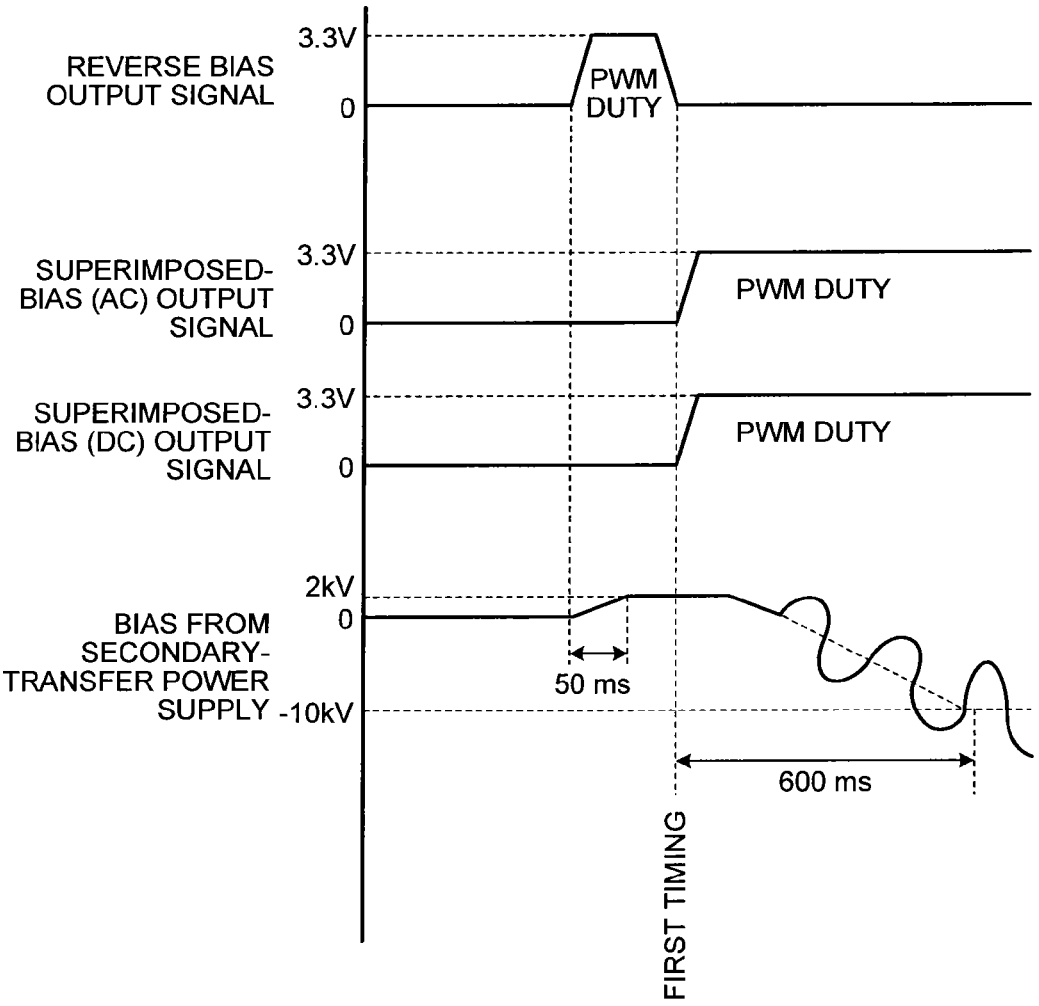
FIG. 5 is a timing diagram of an example of a case that the high-voltage output is performed at the superimposed bias in the first embodiment.

FIG. 5 is a timing diagram of an example of a case that the high-voltage output is performed at the superimposed bias. When the user setting is "high-voltage output at a superimposed bias" and the CPU 140 receives the print start reference signal, the power supply control unit 142 measures an elapsed time since the reception of the print start reference signal and specifies the first timing by referring to the designation information. As illustrated in FIG. 5, at the first timing, the power supply control unit 142 stops outputting a reverse-bias output signal from the I/O control unit 110 to the secondary transfer power supply 200 and outputs a superimposed-bias (DC) output signal, which is a DC-bias output signal for the superimposed bias, and a superimposed-bias (AC) output signal, which is an AC-bias output signal for the superimposed bias, from the I/O control unit 110 to the secondary transfer power supply 200. When receiving the superimposed-bias (DC) output signal and the superimposed-bias (AC) output signal from the I/O control unit 110, the secondary transfer power supply 200 starts to perform the high-voltage output at the superimposed bias on the secondary-transfer-unit opposed roller 63. Therefore, the secondary transfer power supply 200 can apply the target bias value (−10 kilovolts) to the secondary-transfer-unit opposed roller 63 before elapse of 600 milliseconds, that is, before the secondary-transfer-unit opposed roller 63 and the secondary transfer roller 64 transfer a full-color toner image onto the recording sheet P. The power supply control unit 142 need not output the superimposed-bias (AC) output signal and the superimposed-bias (DC) output signal at the same timing. The power supply control unit 142 may output the superimposed-bias (AC) output signal at approximately the same timing as the timing of the superimposed-bias (DC) output signal, or may output the superimposed-bias (AC) output signal after the superimposed-bias (DC) output signal is output.

When the user setting is "high-voltage output at only a DC bias", that is, when the secondary transfer power supply 200 performs a high-voltage output at only the DC voltage, the power supply control unit 142 instructs the secondary transfer power supply 200 to perform the high-voltage output at the second timing.

Figure 6:
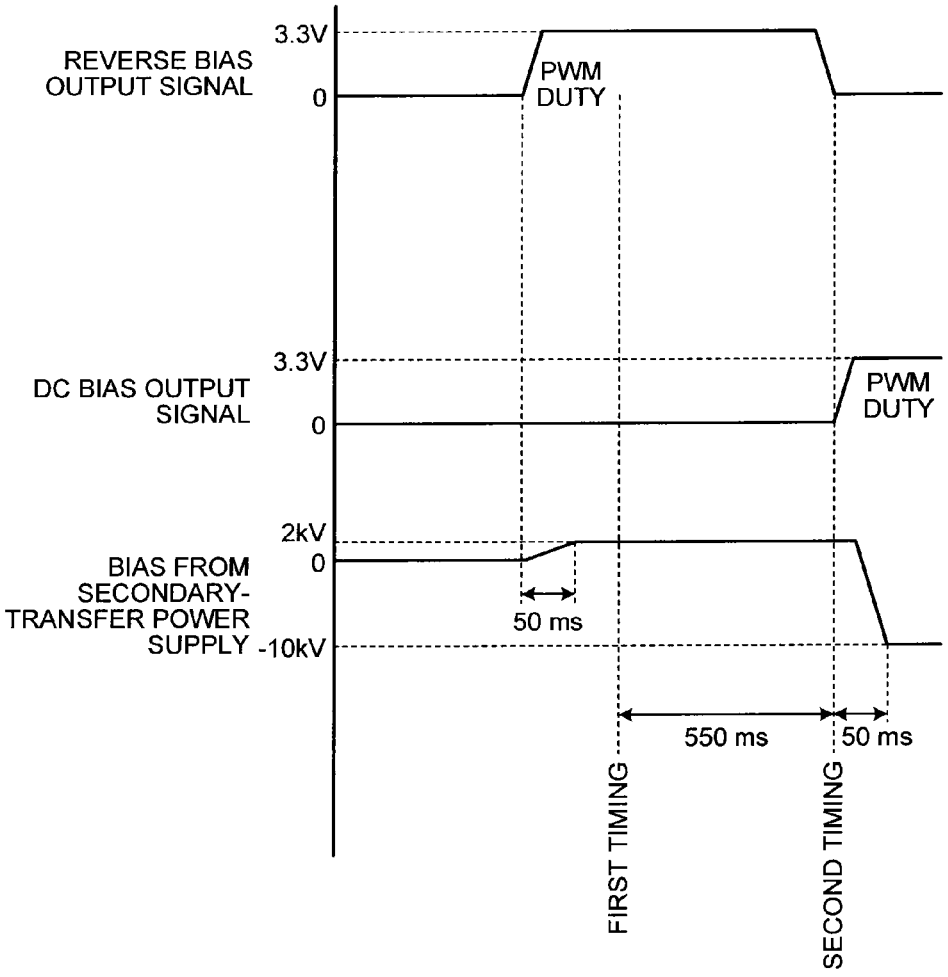
FIG. 6 is a timing diagram of an example of a case that the high-voltage output is performed at only the DC bias in the first embodiment.

FIG. 6 is a timing diagram of an example of a case that the high-voltage output is performed at only the DC bias. When the user setting is "high-voltage output at only a DC bias" and the CPU 140 receives the print start reference signal, the power supply control unit 142 measures an elapsed time since reception of the print start reference signal and specifies the second timing by referring to the designation information and the interval information. As illustrated in FIG. 6, at the second timing, the power supply control unit 142 stops outputting the reverse-bias output signal from the I/O control unit 110 to the secondary transfer power supply 200 and outputs a DC-bias output signal for only a DC bias from the I/O control unit 110 to the secondary transfer power supply 200. When receiving the DC-bias output signal for only the DC bias from the I/O control unit 110, the secondary transfer power supply 200 starts to perform the high-voltage output at only the DC bias on the secondary-transfer-unit opposed roller 63. Therefore, the secondary transfer power supply 200 can apply the target bias value (−10 kilovolts) to the secondary-transfer-unit opposed roller 63 before elapse of 50 milliseconds, that is, before the secondary-transfer-unit opposed roller 63 and the secondary transfer roller 64 transfers the full-color toner image onto the recording sheet P.

Figure 7:
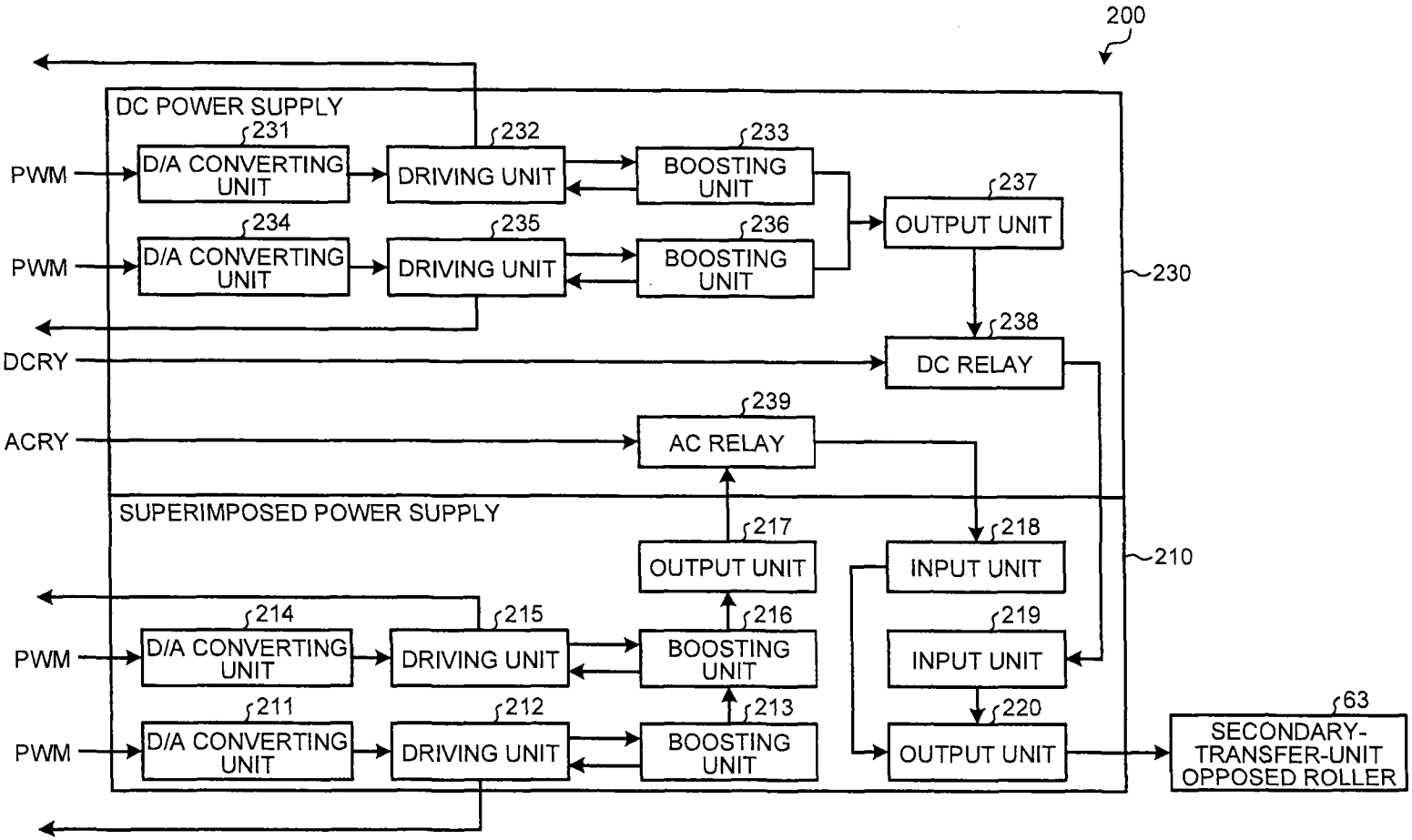
FIG. 7 is a block diagram of an example of an electrical configuration of a secondary transfer power supply according to the first embodiment.

FIG. 7 is a block diagram of an example of an electrical configuration of the secondary transfer power supply 200 according to the first embodiment. As illustrated in FIG. 7, the secondary transfer power supply 200 includes a superimposed power supply 210 and a DC power supply 230. In the first embodiment, the superimposed power supply 210 is detachably attachable to the secondary transfer power supply 200; however the configuration is not limited to this example.

The superimposed power supply 210 includes a D/A converting unit 211, a driving unit 212, a boosting unit 213, a D/A converting unit 214, a driving unit 215, a boosting unit 216, an output unit 217, an input unit 218, an input unit 219, and an output unit 220.

The D/A converting unit 211 receives, from the I/O control unit 110, a PWM signal (a DC-bias output signal) for setting an electric current or a voltage of a DC high-voltage output of the boosting unit 213 and converts the received PWM signal from digital to analog.

The driving unit 212 drives the boosting unit 213 according to the PWM signal which is converted into analog by the D/A converting unit 211. The driving unit 212 outputs an output current value and an output voltage value of the DC high-voltage output of the boosting unit 213 to the I/O control unit 110. This is for the purpose of monitoring a load status in the engine control unit 100.

The boosting unit 213 is driven by the driving unit 212, transforms a DC voltage received from the superimposed power supply 210, and performs a DC high-voltage output. The boosting unit 213 outputs the output current value and the output voltage value of the DC high-voltage output to the driving unit 212.

The D/A converting unit 214 receives, from the I/O control unit 110, a PWM signal (an AC-bias output signal) for setting an electric current or a voltage of an AC high-voltage output of the boosting unit 216 and converts the received PWM signal from digital to analog.

The driving unit 215 drives the boosting unit 216 according to the PWM which is converted into analog by the D/A converting unit 214. The driving unit 215 outputs an output current value and an output voltage value of the AC high-voltage output of the boosting unit 216 to the I/O control unit 110. This is for the purpose of monitoring a load status in the engine control unit 100.

The boosting unit 216 is driven by the driving unit 215, transforms an AC voltage received from the superimposed power supply 210, superimposes the AC high-voltage output and the DC high-voltage output from the boosting unit 213, and performs a superimposed high-voltage output. The boosting unit 216 outputs the output current value and the output voltage value of the AC high-voltage output to the driving unit 215.

The output unit 217 outputs the superimposed high-voltage output of the boosting unit 216 to the DC power supply 230. The output unit 217 includes a load adjustment capacitor for adjusting load.

The superimposed high-voltage output which is output by the output unit 217 is input to the input unit 218 from the DC power supply 230.

The DC high-voltage output from the DC power supply 230 is input to the input unit 219.

When the superimposed high-voltage output is input to the input unit 218, the output unit 220 outputs the superimposed high-voltage output to the secondary-transfer-unit opposed roller 63. When the DC high-voltage output is input to the input unit 219, the output unit 220 outputs the DC high-voltage output to the secondary-transfer-unit opposed roller 63.

The DC power supply 230 includes a D/A converting unit 231, a driving unit 232, a boosting unit 233, a D/A converting unit 234, a driving unit 235, a boosting unit 236, an output unit 237, a DC relay 238, and an AC relay 239.

The D/A converting unit 231 receives, from the I/O control unit 110, a PWM signal (a DC-bias output signal) for setting an electric current or a voltage of a DC high-voltage output (negative) of the boosting unit 233 and converts the received PWM signal from digital to analog.

The driving unit 232 drives the boosting unit 233 according to the PWM signal which is converted into analog by the D/A converting unit 231. The driving unit 232 outputs an output current value and an output voltage value of the DC high-voltage output (negative) of the boosting unit 233 to the I/O control unit 110. This is for the purpose of monitoring a load status in the engine control unit 100.

The boosting unit 233 is driven by the driving unit 232, transforms a DC voltage received from the DC power supply 230, and performs the DC high-voltage output (negative). The boosting unit 233 outputs the output current value and the output voltage value of the DC high-voltage output (negative) to the driving unit 232.

The D/A converting unit 234 receives, from the I/O control unit 110, a PWM signal (a DC-bias output signal) for setting an electric current or a voltage of a DC high-voltage output (positive) of the boosting unit 236 and converts the received PWM signal from digital to analog.

The driving unit 235 drives the boosting unit 236 according to the PWM signal which is converted into analog by the D/A converting unit 234. The driving unit 235 outputs an output current value and an output voltage value of the DC high-voltage output (positive) of the boosting unit 236 to the I/O control unit 110. This is for the purpose of monitoring a load status in the engine control unit 100.

The boosting unit 236 is driven by the driving unit 235, transforms a DC voltage received from the DC power supply 230, and performs the DC high-voltage output (positive). The boosting unit 236 outputs the output current value and the output voltage value of the DC high-voltage output (positive) to the driving unit 235.

The output unit 237 combines the DC high-voltage output (negative) of the boosting unit 233 and the DC high-voltage output (positive) of the boosting unit 236 and outputs the combined output to the DC relay 238.

The DC relay 238 is a relay for switching a high-voltage output to a DC high-voltage output. On and off of the DC relay 238 are switched by a DCRY signal input from the I/O control unit 110. When the DC relay 238 is turned on, the DC relay 238 outputs the DC high-voltage output from the output unit 237 to the superimposed power supply 210.

The AC relay 239 is a relay for switching a high-voltage output to a superimposed high-voltage output. On and off of the AC relay 239 is switched by an ACRY signal input from the I/O control unit 110. When the AC relay 239 is turned on, the AC relay 239 outputs the superimposed high-voltage output from the DC power supply 230 to the superimposed power supply 210.

In this way, the secondary transfer power supply 200 of the first embodiment switches between the DC high-voltage output and the superimposed high-voltage output by the relay.

As described above, when the secondary transfer power supply 200 performs a high-voltage output at the superimposed bias, a longer time is needed to increase the bias value to the target value (before the voltage rises) compared with the case that the high-voltage output is performed at only the DC bias. This is because while the load adjustment capacitor of the output unit 217 maintains a waveform of the AC by storing a certain capacitance, the boosting unit 213 for the superimposed bias (DC) is subjected to constant current control and performs an output with a predetermined low electric current in order to prevent an inrush current, and therefore, it takes a relatively long time to charge the load adjustment capacitor with the superimposed bias (DC). Therefore, the rise timing of the voltage is delayed. While the superimposed bias (AC) is also charged to the load adjustment capacitor, the boosting unit 216 for the superimposed bias (AC) is subjected to constant current control so as not to cause a problem even when a large voltage is superimposed from the beginning. Therefore, it takes a relatively short time to charge the load adjusting capacitor. Consequently, the power supply control unit 142 can output the superimpose-bias (AC) output signal after the superimposed-bias (DC) output signal is output or can output the superimposed-bias (AC) output signal at approximately the same timing as the timing of the superimposed-bias (DC) output signal.

Figure 8:
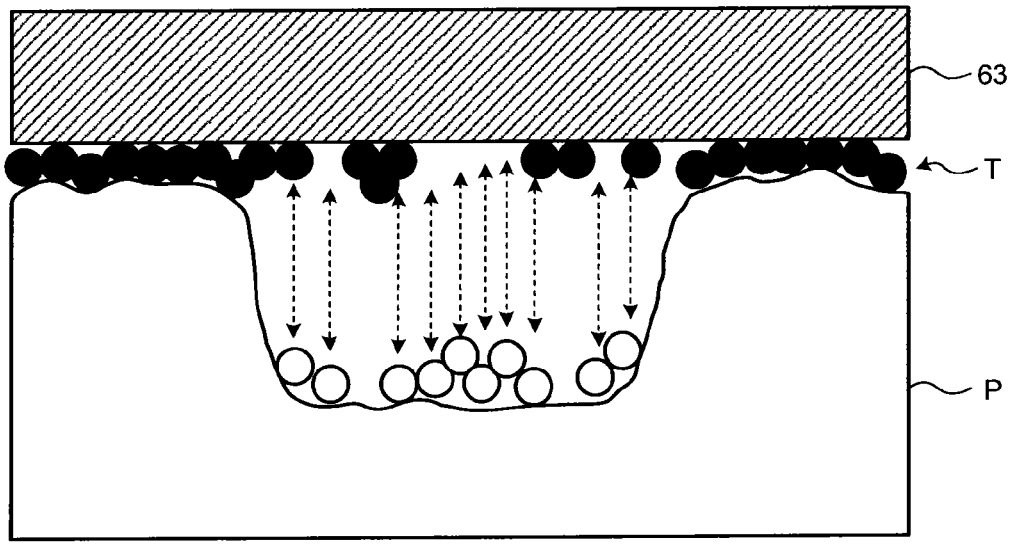
FIG. 8 is a diagram for explaining an example of a principle of toner adhesion to a recording sheet when the secondary transfer power supply applies the superimposed bias to a secondary-transfer-unit opposed roller according to the first embodiment.

FIG. 8 is a diagram for explaining an example of a principle of toner adhesion to the recording sheet P when the secondary transfer power supply 200 applies the superimposed bias to the secondary-transfer-unit opposed roller 63 according to the first embodiment. When the superimposed bias is applied to the secondary-transfer-unit opposed roller 63, an alternating-current waveform is obtained. Therefore, a voltage from the secondary-transfer-unit opposed roller 63 to the secondary transfer roller 64 and a voltage from the secondary transfer roller 64 to the secondary-transfer-unit opposed roller 63 are switched at a predetermined cycle. Consequently, as illustrated in FIG. 8, toner T of a full-color toner image formed on the intermediate transfer belt 60 (not illustrated) starts to move in a direction toward a recording sheet P and in the opposite direction. At a certain voltage level, the toner adheres to recesses of the recording sheet p.

The operation of the printing apparatus according to the first embodiment will be explained.

Figure 9:
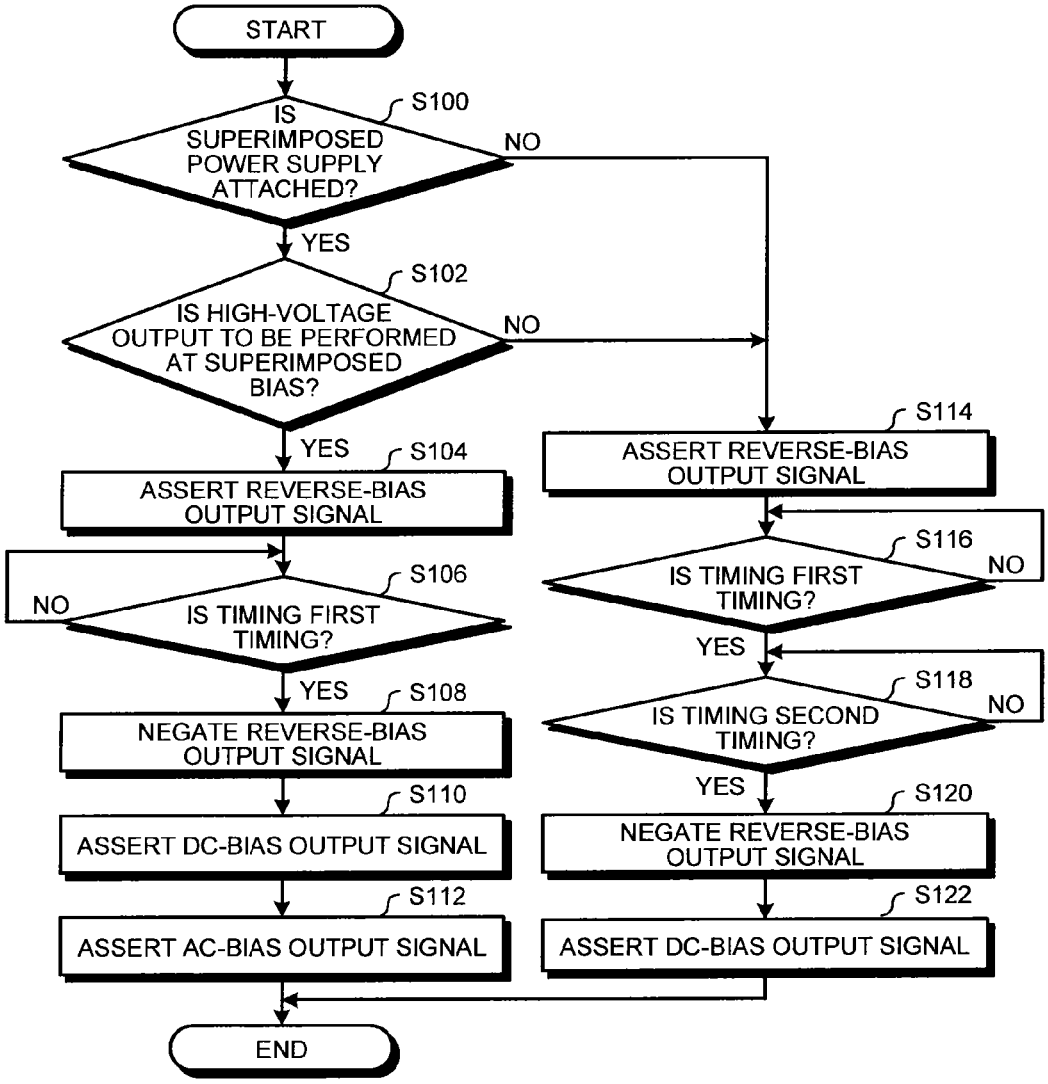
FIG. 9 is a flowchart of an example of a transfer control process performed by the printing apparatus according to the first embodiment.

FIG. 9 is a flowchart of an example of a transfer control process performed by the printing apparatus 1 according to the first embodiment.

The CPU 140 confirms whether the superimposed power supply 210 is attached to the secondary transfer power supply 200 (Step S100).

When the superimposed power supply 210 is attached to the secondary transfer power supply 200 (YES at Step S100), the CPU 140 confirms whether a high-voltage output at the superimposed bias is to be performed based on the user setting on the high-voltage output (Step S102).

When the high-voltage output at the superimposed bias is to be performed (YES at Step S102), the power supply control unit 142 asserts the reverse-bias output signal to output the reverse-bias output signal from the I/O control unit 110 to the secondary transfer power supply 200 (Step S104).

The power supply control unit 142 specifies the first timing based on an elapsed time since reception of the print start reference signal and based on the designation information (NO at Step S106).

At the first timing (YES at Step S106), the power supply control unit 142 negates the reverse-bias output signal to stop outputting the reverse-bias output signal from the I/O control unit 110 to the secondary transfer power supply 200 (Step S108).

Subsequently, the power supply control unit 142 asserts the DC-bias output signal to output the DC-bias output signal from the I/O control unit 110 to the secondary transfer power supply 200 (Step S110) and asserts the AC-bias output signal to output the AC-bias output signal from the I/O control unit 110 to the secondary transfer power supply 200 (Step S112).

Therefore, even when the high-voltage output is performed at the superimposed bias, the secondary transfer power supply 200 can apply the target bias value (−10 kilovolts) to the secondary-transfer-unit opposed roller 63 before the secondary-transfer-unit opposed roller 63 and the secondary transfer roller 64 transfer a full-color toner image onto the recording sheet P.

On the other hand, when the superimposed power supply 210 is not attached to the secondary transfer power supply 200 (NO at Step S100) or when the high-voltage output at the superimposed bias is not to be performed (NO at Step S102), the power supply control unit 142 asserts the reverse-bias output signal to output the reverse-bias output signal from the I/O control unit 110 to the secondary transfer power supply 200 (Step S114).

The power supply control unit 142 specifies the first timing based on an elapsed time since reception of the print start reference signal and based on the designation information (NO at Step S116).

At the first timing (YES at Step S116), the power supply control unit 142 specifies the second timing based on an elapsed time from the first timing and the interval information (NO at Step S118).

At the second timing (YES at Step S118), the power supply control unit 142 negates the reverse-bias output signal to stop outputting the reverse-bias output signal from the I/O control unit 110 to the secondary transfer power supply 200 (Step S120).

Subsequently, the power supply control unit 142 asserts the DC-bias output signal to output the DC-bias output signal from the I/O control unit 110 to the secondary transfer power supply 200 (Step S122).

Therefore, even when the high-voltage output is performed at only the DC bias, the secondary transfer power supply 200 can apply the target bias value (−10 kilovolts) to the secondary-transfer-unit opposed roller 63 before the secondary-transfer-unit opposed roller 63 and the secondary transfer roller 64 transfer a full-color toner image onto the recording sheet P.

As described above, in the first embodiment, when the high-voltage output is performed at the superimposed bias, an output instruction is issued to the secondary transfer power supply at an earlier timing by taking into account the fact that the voltage rises at a later timing compared with the case where the high-voltage output is performed at the DC bias. Therefore, according to the first embodiment, even when the high-voltage output is performed at the superimposed bias, it is possible to apply a target bias value to the secondary-transfer-unit opposed roller before a secondary transfer is performed. As a result, it is possible to reduce density unevenness or density reduction of an image.

When the high-voltage output is performed at the superimposed bias, and if an output instruction is issued to the secondary transfer power supply at the same timing as the timing of the case where the high-voltage output is performed at the DC bias, the bias value of the secondary transfer power supply cannot reach the target bias value before the secondary transfer is performed. Therefore, it becomes impossible to apply the target bias value to the secondary-transfer-unit opposed roller. As a result, density unevenness or density reduction of an image may occur.

Furthermore, according to the first embodiment, the output timing of the high-voltage output is specified by software. Therefore, it is not necessary to prepare hardware for specifying the output timing of the high-voltage output, enabling to reduce the size of the printing apparatus.

Second Embodiment

In a second embodiment, an example will be explained in which, when the high-voltage output is performed at the superimposed bias, the AC-bias output signal is output after the DC-bias output signal is output. In the following, differences from the first embodiment will be mainly explained. Components having the same functions as those of the first embodiment are denoted by the same names, reference numerals, and signs as those in the first embodiment and explanation thereof is not repeated.

Figure 10:
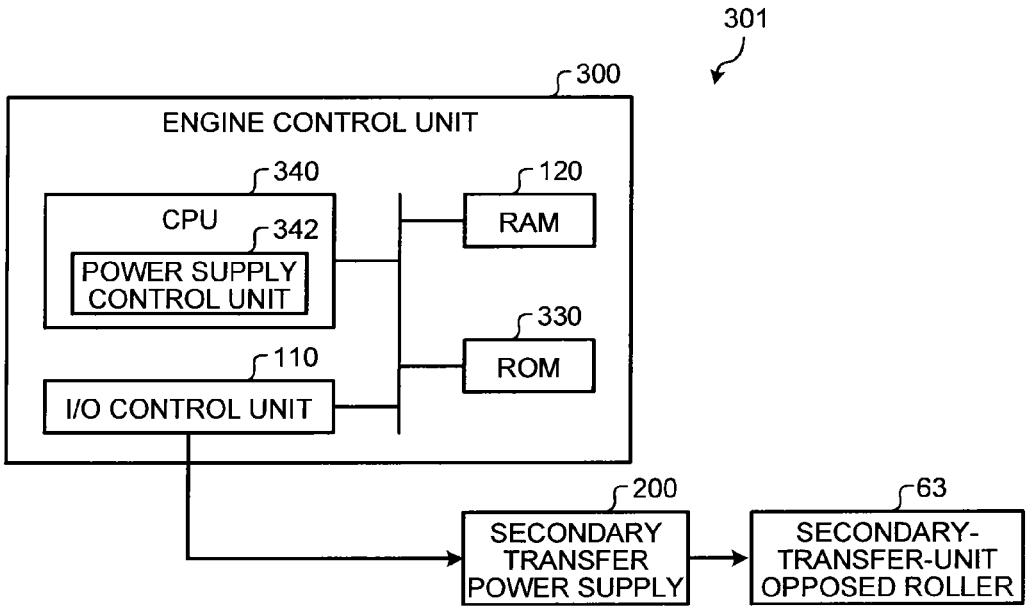
FIG. 10 is a block diagram of an example of an electrical configuration of a printing apparatus according to a second embodiment.

FIG. 10 is a block diagram of an example of an electrical configuration of a printing apparatus 301 according to the second embodiment. As illustrated in FIG. 10, the printing apparatus 301 of the second embodiment is different from the printing apparatus 1 of the first embodiment in that it includes a ROM 330 of an engine control unit 300 and a power supply control unit 342 of a CPU 340.

The ROM 330 stores therein, for example, designation information for designating the first timing, which is a timing at which the DC-bias output signal is output to the secondary transfer power supply 200 when the secondary transfer power supply 200 performs the high-voltage output at a superimposed bias. The ROM 330 also stores therein interval information indicating the interval between the first timing and the second timing as described above, and an interval between the first timing and a third timing, which is a timing at which the AC-bias output signal is output to the secondary transfer power supply 200 when the secondary transfer power supply 200 performs the high-voltage output at the superimposed bias.

Figure 11:
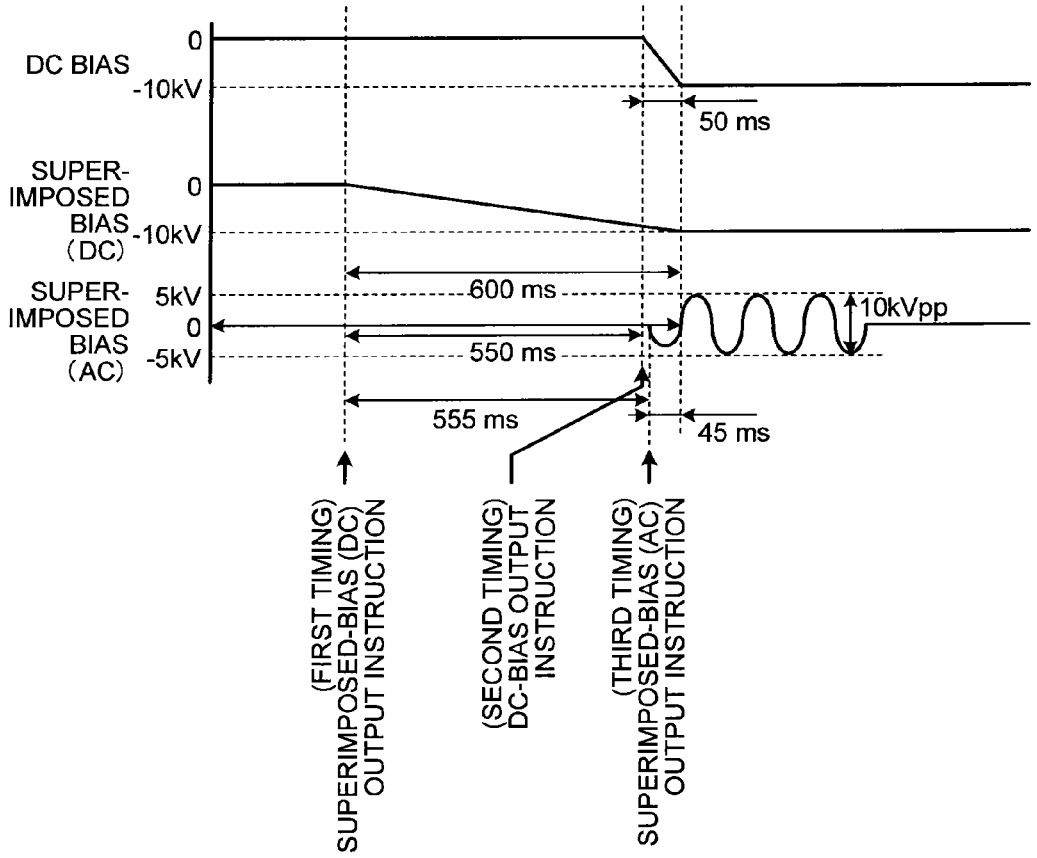
FIG. 11 is a diagram for explaining an example of the rise timing of a high-voltage output at a superimposed bias and a high-voltage output at a DC bias according to the second embodiment.

The first to third timings will be explained below. FIG. 11 is a diagram for explaining an example of the rise timing of the high-voltage output at the superimposed bias and the rise timing of the high-voltage output at the DC bias according to the second embodiment. As illustrated in FIG. 11, when the secondary transfer power supply 200 performs the high-voltage output at only the DC bias, it takes 50 milliseconds from when the DC-bias output instruction is issued to the secondary transfer power supply 200 (the DC-bias output signal is output to the secondary transfer power supply 200) to when the bias value of the secondary transfer power supply 200 reaches the target value (−10 kilovolts). On the other hand, when the secondary transfer power supply 200 performs the high-voltage output at the superimposed bias, it takes 600 milliseconds from when a superimposed-bias (DC) output instruction is issued to the secondary transfer power supply 200 (the DC-bias output signal is output to the secondary transfer power supply 200) to when the bias value of the secondary transfer power supply 200 reaches the target value (−10 kilovolts). Furthermore, it takes 45 milliseconds from when a superimposed-bias (AC) output instruction is issued to the secondary transfer power supply 200 (the AC-bias output signal is output to the secondary transfer power supply 200) to when the bias value of the secondary transfer power supply 200 reaches a target value (10 kilovolts peak-to-peak).

In this way, when the secondary transfer power supply 200 performs the high-voltage output at the superimposed bias, because an AC is superimposed on a DC having a large bias output value, a longer time is needed before the bias value of the superimposed bias (DC) reaches a target value (before the voltage rises) compared with the case that the high-voltage output is performed at only the DC bias. Incidentally, a time needed to increase the bias value of the superimposed bias (AC) to a target value is 5 milliseconds shorter compared with the case that the high-voltage output is performed at only the DC bias.

Therefore, in the second embodiment, when the secondary transfer power supply 200 performs the high-voltage output at the superimposed bias, it is assumed that the first timing is a timing at which the superimposed-bias (DC) output instruction is issued to the secondary transfer power supply 200 (the DC-bias output signal is output to the secondary transfer power supply). The designation information designates the first timing based on an elapsed time since reception of the print start reference signal (not illustrated) by the CPU 340. Furthermore, in the second embodiment, it is assumed that the third timing is a timing at which the superimposed-bias (AC) output instruction is issued to the secondary transfer power supply 200 (the AC-bias output signal is output to the secondary transfer power supply 200). Moreover, in the second embodiment, when the secondary transfer power supply 200 performs the high-voltage output at only the DC bias, it is assumed that the second timing is a timing at which the DC-bias output instruction is issued to the secondary transfer power supply 200 (the DC-bias output signal is output to the secondary transfer power supply 200). The interval information specifies the second timing and the third timing based on intervals from the first timing. That is, in the second embodiment, the interval between the first timing and the second timing indicated by the interval information is 550 milliseconds, and the interval between the first timing and the third timing indicated by the interval information is 555 milliseconds. Therefore, when the secondary transfer power supply 200 performs the high-voltage output at the superimposed bias, the DC-bias output instruction is issued to the secondary transfer power supply 200 550 milliseconds earlier compared with the case that the secondary transfer power supply 200 performs the high-voltage output at only the DC bias. After a lapse of 555 milliseconds, the AC bias output instruction is issued to the secondary transfer power supply 200.

When the user setting is "high-voltage output at a superimposed bias", that is, when the secondary transfer power supply 200 performs the high-voltage output at the superimposed voltage, the power supply control unit 342 instructs the secondary transfer power supply 200 to perform the high-voltage output at the first and the third timings.

Figure 12:
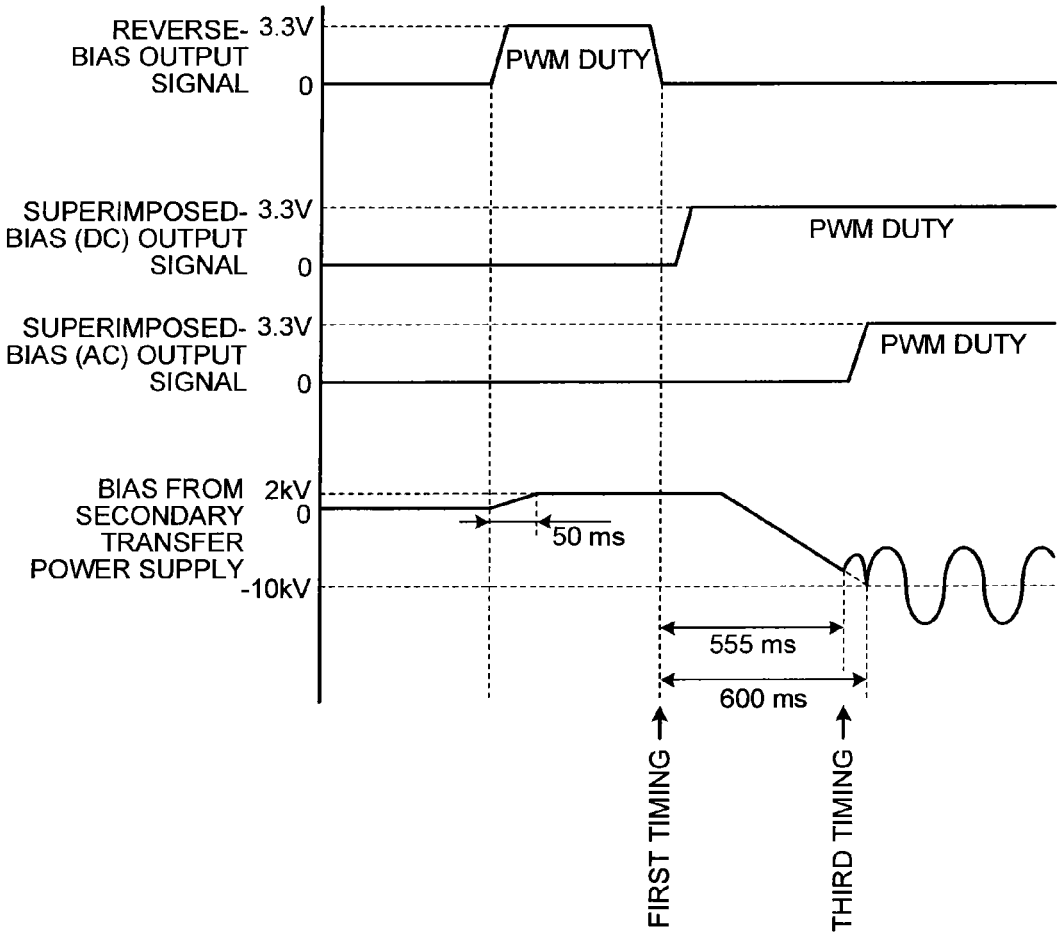
FIG. 12 is a timing diagram of an example of a case that the high-voltage output is performed at the superimposed bias in the second embodiment.

FIG. 12 is a timing diagram of an example of a case that the high-voltage output is performed at the superimposed bias in the second embodiment. When the user setting is "high-voltage output at a superimposed bias" and the CPU 340 receives the print start reference signal, the power supply control unit 342 measures an elapsed time, specifies the first timing by referring to the designation information, and specifies the third timing by referring to the interval information. As illustrated in FIG. 12, at the first timing, the power supply control unit 342 stops outputting the reverse-bias output signal from the I/O control unit 110 to the secondary transfer power supply 200 and outputs a superimposed-bias (DC) output signal, which is a DC-bias output signal for the superimposed bias, from the I/O control unit 110 to the secondary transfer power supply 200. As illustrated in FIG. 12, at the third timing, the power supply control unit 342 also outputs a superimposed-bias (AC) output voltage, which is an AC-bias output signal for the superimposed bias, from the I/O control unit 110 to the secondary transfer power supply 200. When receiving the superimposed-bias (DC) output signal from the I/O control unit 110, the secondary transfer power supply 200 starts to perform the high-voltage output at the superimposed bias (DC) to the secondary-transfer-unit opposed roller 63. When receiving the superimposed-bias (AC) output signal from the I/O control unit 110, the secondary transfer power supply 200 starts to perform the high-voltage output at the superimposed bias (AC) to the secondary-transfer-unit opposed roller 63. Therefore, the secondary transfer power supply 200 can start to perform the high-voltage output at the superimposed bias after a lapse of 555 milliseconds and apply target bias values (DC: −10 kilovolts, AC: −10 kilovolts peak-to-peak) to the secondary-transfer-unit opposed roller 63 before a lapse of 600 milliseconds, that is, before the secondary-transfer-unit opposed roller 63 and the secondary transfer roller 64 transfer a full-color toner image onto the recording sheet P.

Figure 13:
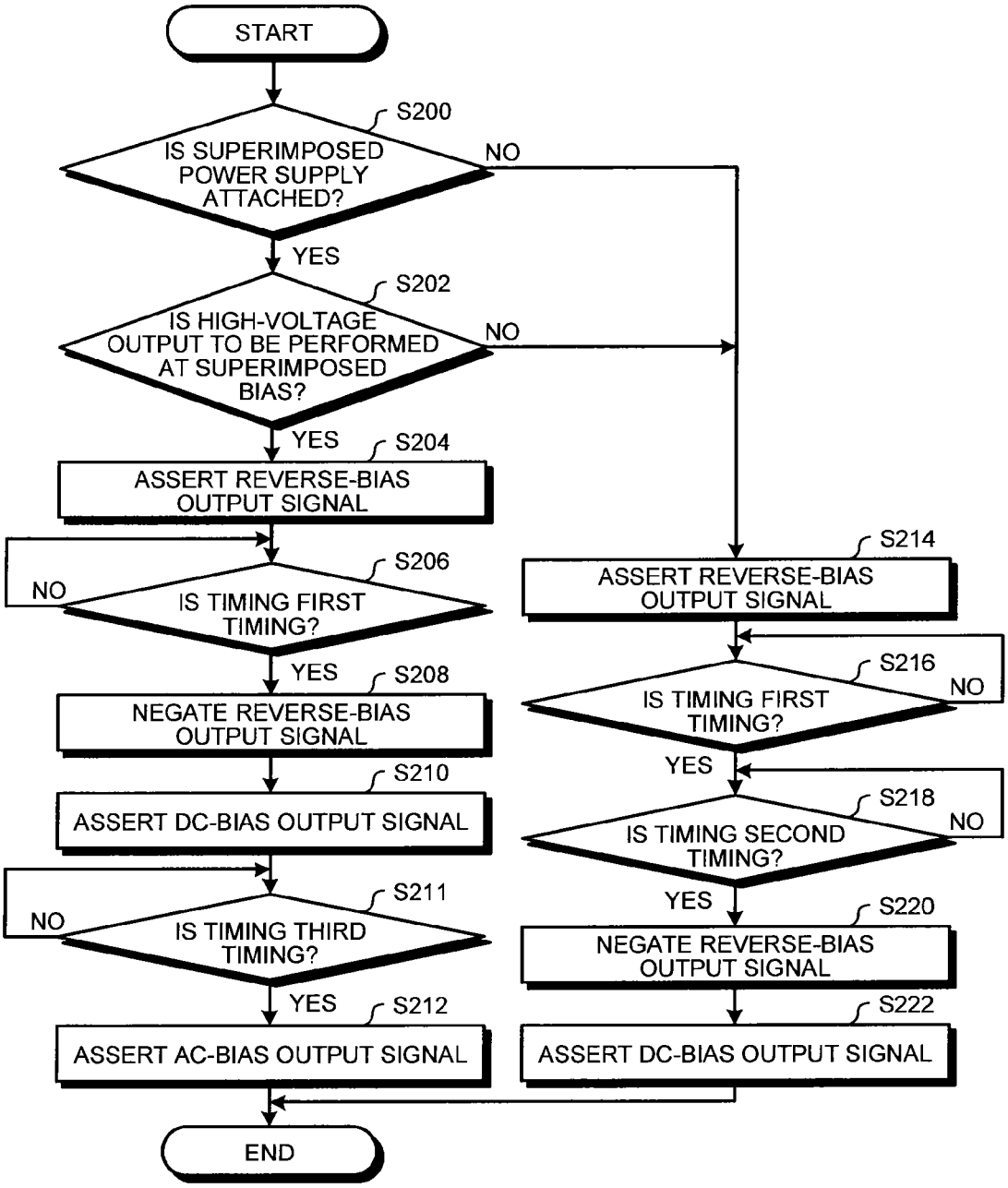
FIG. 13 is a flowchart of an example of a transfer control process performed by the printing apparatus according to the second embodiment.

FIG. 13 is a flowchart of an example of a transfer control process performed by the printing apparatus 301 according to the second embodiment.

The processes from Steps S200 to S210 are the same as the processes from Steps S100 to S110 in the flowchart in FIG. 9.

The power supply control unit 342 specifies the third timing based on an elapsed time from the first timing and the interval information (NO at Step S211).

At the third timing (YES at Step S211), the power supply control unit 342 asserts the AC-bias output signal to output the AC-bias output signal from the I/O control unit 110 to the secondary transfer power supply 200 (Step S212).

Therefore, even when the high-voltage output is performed at the superimposed bias, the secondary transfer power supply 200 can apply the target bias values (DC: −10 kilovolts, AC: 10 kilovolts peak-to-peak) to the secondary-transfer-unit opposed roller 63 before the secondary-transfer-unit opposed roller 63 and the secondary transfer roller 64 transfer a full-color toner image onto the recording sheet P.

The processes from Steps S214 to S222 are the same as the processes from Steps S114 to S122 in the flowchart in FIG. 9.

As described above, in the second embodiment, it is possible to achieve the same advantages as those of the first embodiment.

Hardware Configuration

Each of the printing apparatuses 1 and 301 of the above embodiments has a hardware configuration using a normal computer and includes a control device, such as a central processing unit (CPU); a storage device, such as a ROM or a RAM; an external storage device, such as a hard disk drive (HDD) or a solid-state drive (SDD); a display device, such as a display; an input device, such as a mouse or a keyboard; and a communication device, such as a communication I/F.

A program executed by the printing apparatuses 1 and 301 of the above embodiments is provided by being installed in a computer-readable recording medium, such as a compact disk ROM (CD-ROM), a compact disk recordable (CD-R), a memory card, a digital versatile disk (DVD), or a flexible disk (FD), in a computer-installable or a computer-executable file format.

The program executed by the printing apparatuses 1 and 301 of the above embodiments may be stored in a computer connected to a network, such as the Internet, and provided by being downloaded via the network. The program executed by the printing apparatuses 1 and 301 of the above embodiments may be provided or distributed via a network, such as the Internet. The program executed by the printing apparatuses 1 and 301 of the above embodiments may be provided by being incorporated in a ROM or the like in advance.

The program executed by the printing apparatuses 1 and 301 of the above embodiments has a module structure for realizing the above units on a computer. As actual hardware, for example, a CPU reads the program from the ROM onto the RAM and executes the program to realize the above units on the computer.

Modification

The present invention is not limited to the above embodiments and may be modified in various forms.

First Modification

In the first embodiment, the output timing of the high-voltage output is specified by using the designation information designating the first timing and the interval information indicating the interval between the first timing and the second timing. However, the way to specify the output timing of the high-voltage output is not limited to the above examples. For example, the designation information may designate the second timing instead of the first timing. Furthermore, the designation information may designate not only the first timing but also the second timing. In this case, the interval information is not needed.

Second Modification

In the second embodiment, the output timing of the high-voltage output is specified by using the designation information designating the first timing and the interval information indicating the interval between the first timing and the second timing and the interval between the first timing and the third timing. However, the way to specify the output timing of the high-voltage output is not limited to the above example. For example, the designation information may designate the second timing or the third timing instead of the first timing. Furthermore, the designation information may designate not only the first timing but also the second timing and the third timing. In this case, the interval information is not needed. Namely, it is sufficient that the designation information designates at least one of the first timing, the second timing, and the third timing.

Third Modification

In the above embodiments, an example is explained in which the high-voltage output is performed at a superimposed bias, which is obtained by superimposing a direct-current voltage and an alternating-current voltage, when an image is transferred onto a recording sheet having large irregularities, such as leathac paper. However, the present invention is not limited to this example. For example, it may be possible to perform a high-voltage output at only an alternating-current voltage (an alternating-current bias) when an image is transferred onto a recording sheet having large irregularities. Namely, it is sufficient to perform a high-voltage output by using at least the alternating-current voltage.

Fourth Modification

In the above embodiments, an example is explained in which the secondary transfer power supply 200 for transfer bias is connected to the secondary-transfer-unit opposed roller 63 and applies the transfer bias to the secondary-transfer-unit opposed roller 63. However, the toner image can surely be transferred to a recording sheet even when the secondary transfer power supply 200 for transfer bias is connected to the secondary transfer roller 64 and applies the transfer bias to the secondary transfer roller 64. Furthermore, for example, the toner image can surely be transferred to a recording sheet even when one end of the secondary transfer power supply 200 for transfer bias is connected to the secondary-transfer-unit opposed roller 63 and the other end is connected to the secondary transfer roller 64.

Fifth Modification

In the above embodiments, the output timing of the high-voltage output is specified by software. However, the output timing may be specified by hardware.

Sixth Modification

Figure 14:
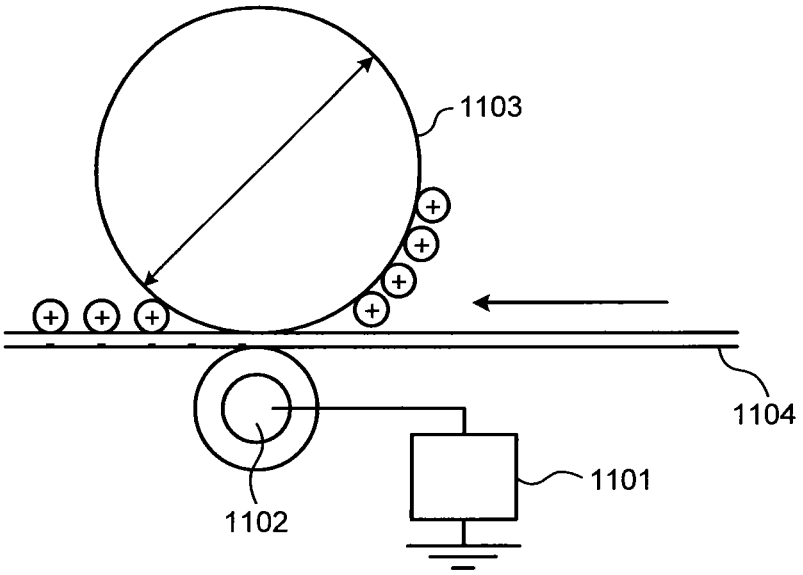
FIG. 14 is a diagram for explaining a sixth modification.

For example, as illustrated in FIG. 14, it is possible to apply the same power supply configuration as that of the above embodiments to a power supply 1101 in the configuration in which a medium-resistance transfer roller 1102 is in contact with a photosensitive drum 1103, a bias is applied from the power supply 1101 to the transfer roller 1102, toner is transferred to a recording sheet 1104, and the recording sheet is conveyed.

The configuration of an image forming unit including the photosensitive drum 1103 or the like is the same as that of the above embodiments. In the transfer roller 1102, a resistive layer made of conductive sponge is formed on a core bar made of stainless or aluminum. It may be possible to form a surface layer made of fluorine resin on the surface of the resistive layer.

A transfer nip (not illustrated) is formed by contact between the photosensitive drum 1103 and the transfer roller 1102. The photosensitive drum 1103 is grounded, the power supply 1101 is connected to the transfer roller 1102, and a transfer bias is applied to the transfer roller 1102. Therefore, a transfer electric field for electrostatically directing toner from the photosensitive drum 1103 to the transfer roller 1102 side is generated between the photosensitive drum 1103 and the transfer roller 1102, and a toner image on the photosensitive drum 1103 is transferred onto the sheet 1104 conveyed to the transfer nip by the action of the transfer electric field or nip pressure.

Seventh Modification

Figure 15:
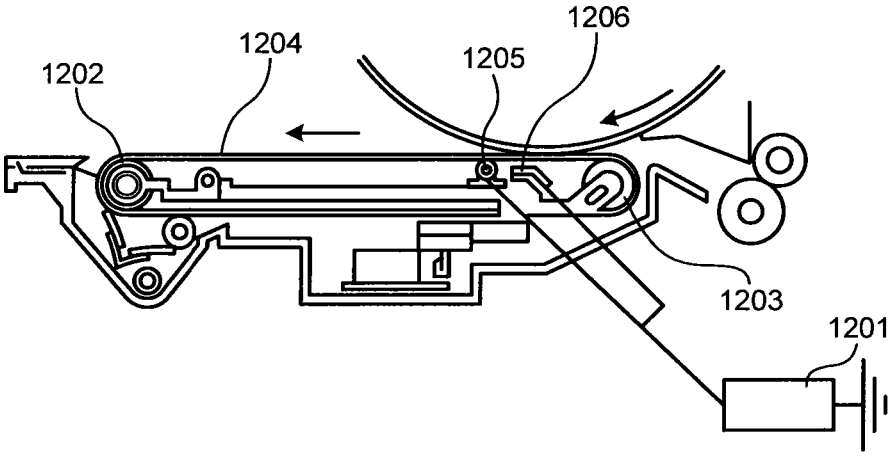
FIG. 15 is a diagram for explaining a seventh modification.

For example, as illustrated in FIG. 15, it is possible to apply the same power supply configuration as that of the above embodiments to a power supply 1201 in the configuration in which a medium-resistance transfer belt 1204 is in contact with a photosensitive drum, a bias is applied from the power supply 1201 to the transfer belt 1204, toner is transferred onto a sheet, and the sheet is conveyed.

The configuration of an image forming unit including the photosensitive drum or the like is the same as that of the above embodiments. The transfer belt 1204 is wound around and supported by a driving roller 1202 and a driven roller 1203, and is moved in an arrow direction in FIG. 15 by the driving roller 1202. The transfer belt 1204 is in contact with the photosensitive drum between the driving roller 1202 and the driven roller 1203. A transfer bias roller 1205 and a bias brush 1206 are arranged on the inner side of the loop of the transfer belt 1204, and are in contact with the transfer belt at a position downstream of a region where the photosensitive drum and the transfer belt 1204 are in contact with each other.

A transfer nip (not illustrated) is formed by contact between the photosensitive drum and the transfer bias roller 1205. The photosensitive drum is grounded, the power supply 1201 is connected to the transfer bias roller 1205, and a transfer bias is applied to the transfer bias roller 1205. Therefore, a transfer electric field for electrostatically directing toner from the photosensitive drum to the transfer bias roller 1205 is generated between the photosensitive drum and the transfer bias roller 1205, and a toner image on the photosensitive drum is transferred onto a sheet conveyed to the transfer nip by the action of the transfer electric field or nip pressure.

It is possible to arrange only one of the transfer bias roller 1205 and the bias brush 1206. It is possible to arrange one of the transfer bias roller 1205 and the bias brush 1206 just below the transfer nip. It is also possible to use a transfer charger instead of the transfer bias roller 1205 and the bias brush 1206.

Eighth Modification

Figure 16:
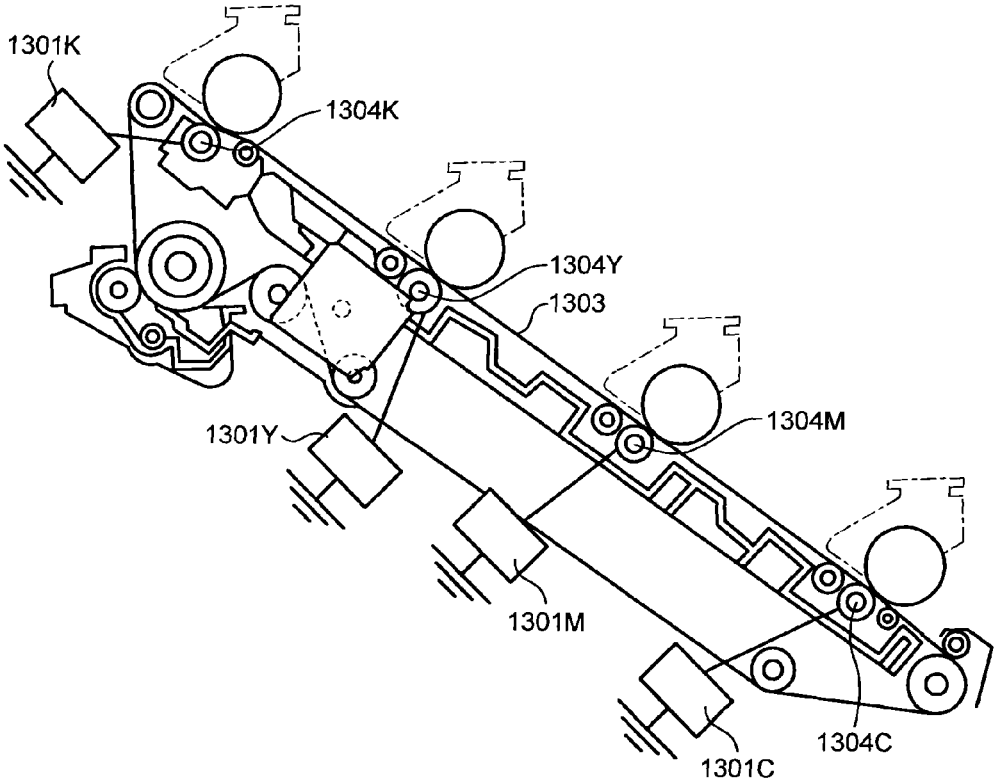
FIG. 16 is a diagram for explaining an eighth modification.

For example, as illustrated in FIG. 16, it is possible to apply the same power supply configuration as that of the above embodiments to power supplies 1301C, 1301M, 1301Y, and 1301K in the configuration in which transfer rollers 1304C, 1304M, 1304Y, and 1304K for CMYK are in contact with photosensitive drums for CMYK via a medium-resistance transfer belt 1303, a bias is applied from the power supplies 1301C, 1301M, 1301Y, and 1301K to the transfer rollers 1304C, 1304M, 1304Y, and 1304K, respectively, toner is transferred to a sheet, and the sheet is conveyed.

Image forming units for colors, each including one of the photosensitive drums for colors, are configured in the same way as described in the above embodiments except for the colors of toner.

The transfer belt 1303 is wound around and supported by a plurality of rollers and moves in a counterclockwise direction in FIG. 16. The transfer belt 1303 is in contact with each of the photosensitive drums for colors. The transfer rollers 1304C, 1304M, 1304Y, and 1304K for colors are arranged on the inner side of the loop of the transfer belt 1303 and are in contact with the transfer belt 1303 so as to be opposed to the photosensitive drums for colors.

A transfer nip is formed by contact between the transfer roller 1304C and a photosensitive drum for C. The photosensitive drum for C is grounded, the power supply 1301C is connected to the transfer roller 1304C, and a transfer bias is applied to the transfer roller 1304C. Therefore, a transfer electric field for electrostatically directing toner for C from the photosensitive drum for C to the transfer roller 1304C is generated at the transfer nip. The same operation as above is performed on the photosensitive drums, the transfer rollers, and the power supplies for the other colors.

The sheet is conveyed from the lower right side in FIG. 16, sticks to the transfer belt 1303 by passing through between a sheet sticking roller to which a bias is applied and the transfer belt 1303, and is convened to the transfer nips for colors. Toner images on the photosensitive drums are sequentially transferred onto a sheet conveyed to the transfer nips by the action of the transfer electric fields or nip pressure, so that a full-color toner image is formed on the sheet.

It may be possible to provide a single power supply instead of the power supplies 1301C, 1301M, 1301Y, and 1301K for colors and apply a bias to the transfer rollers 1304C, 1304M, 1304Y, and 1304K by the single power supply.

Ninth Modification

Figure 17:
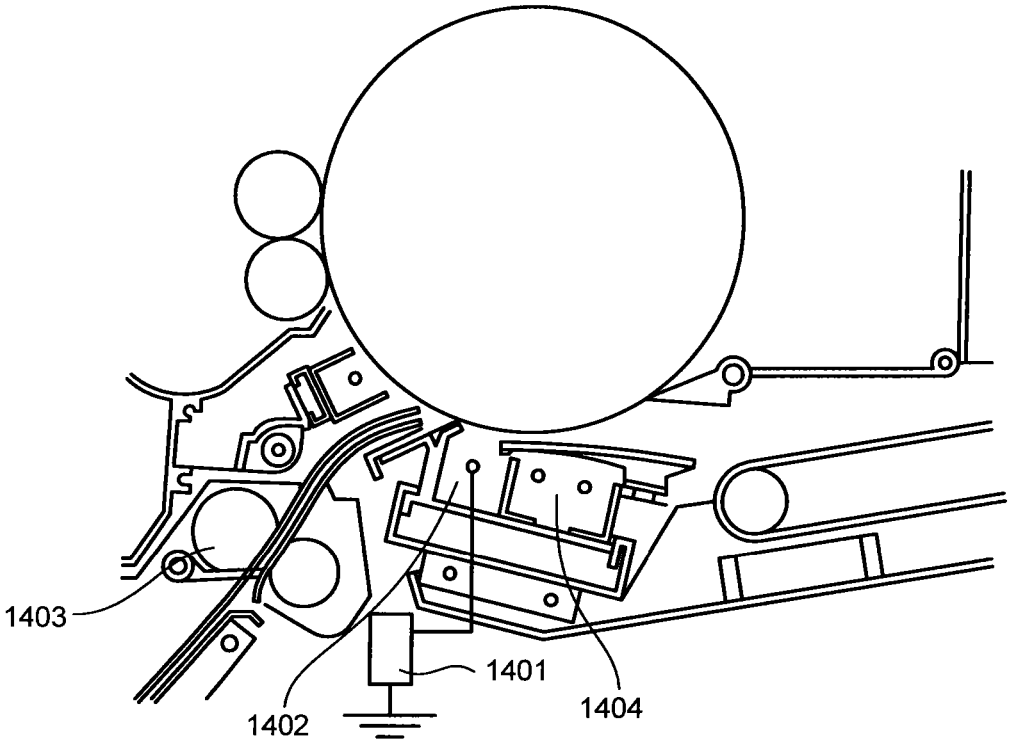
FIG. 17 is a diagram for explaining a ninth modification.

For example, as illustrated in FIG. 17, it is possible to apply the same power supply configuration as that of the above embodiments to a power supply 1401 in a sheet transfer-separation conveying system in which a transfer charger 1402 and a separation charger 1404 are disposed near a photosensitive drum, bias is applied from the power supply 1401 to wire of the transfer charger 1402, toner is transferred to a sheet, and the sheet is conveyed.

The sheet passes through a registration roller 1403, is subjected to transfer of toner by the transfer charger 1402, is separated by the separation charger 1404, and is conveyed to a fixing unit.

Tenth Modification

Figure 18:
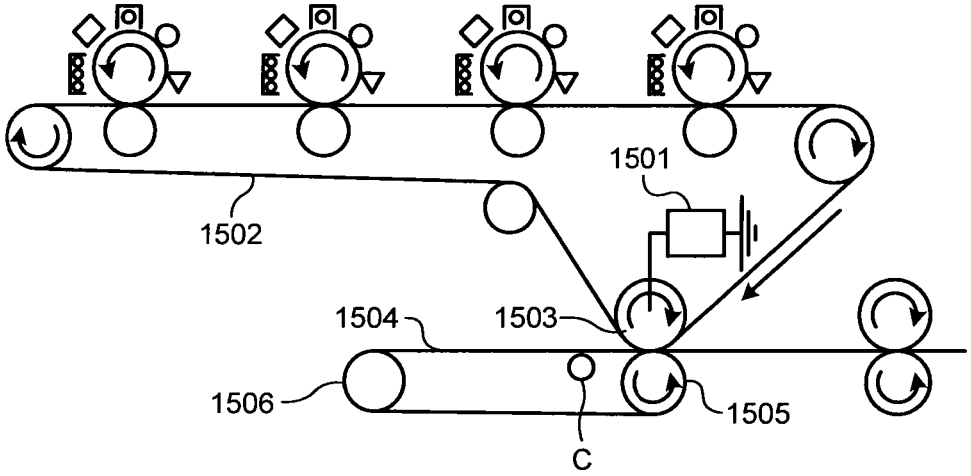
FIG. 18 is a diagram for explaining a tenth modification.

For example, as illustrated in FIG. 18, it is possible to apply the same power supply configuration as that of the above embodiments to a power supply 1501 in a sheet transfer-separation conveying system in which an intermediate transfer belt 1502 is in contact with a secondary transfer belt 1504, a bias is applied from the power supply 1501 to an opposed roller 1503, toner is transferred to a sheet, and the sheet is conveyed.

Image forming units for colors, each including one of the photosensitive drums for CMYK, are configured in the same way as described in the embodiments except for the colors of toner.

The secondary transfer belt 1504 is wound around and supported by a driving roller 1505 and a driven roller 1506 and is moved in a counterclockwise direction by the driving roller 1505. The secondary transfer belt 1504 is in contact with the intermediate transfer belt 1502.

A secondary transfer nip is formed by contact between the secondary transfer belt 1504 and the intermediate transfer belt 1502. The driving roller 1505 is grounded, the power supply 1501 is connected to the opposed roller 1503, and a transfer bias is applied to the opposed roller 1503. Therefore, a transfer electric field for electrostatically directing toner from the intermediate transfer belt 1502 to the secondary transfer belt 1504 side is generated at the secondary transfer nip. A toner image on the intermediate transfer belt 1502 is transferred onto a sheet that has entered the secondary transfer nip by the action of the secondary transfer electric field or nip pressure.

The configuration may be modified such that the opposed roller 1503 is grounded, a roller C is provided, the power supply 1501 is connected to the roller C, and a transfer bias is applied to the roller C.

Eleventh Modification

For example, in the above embodiments, a printing system (image forming system) may include a server apparatus in addition to the printing apparatus and the server apparatus may include a power supply control unit.

Figure 19:
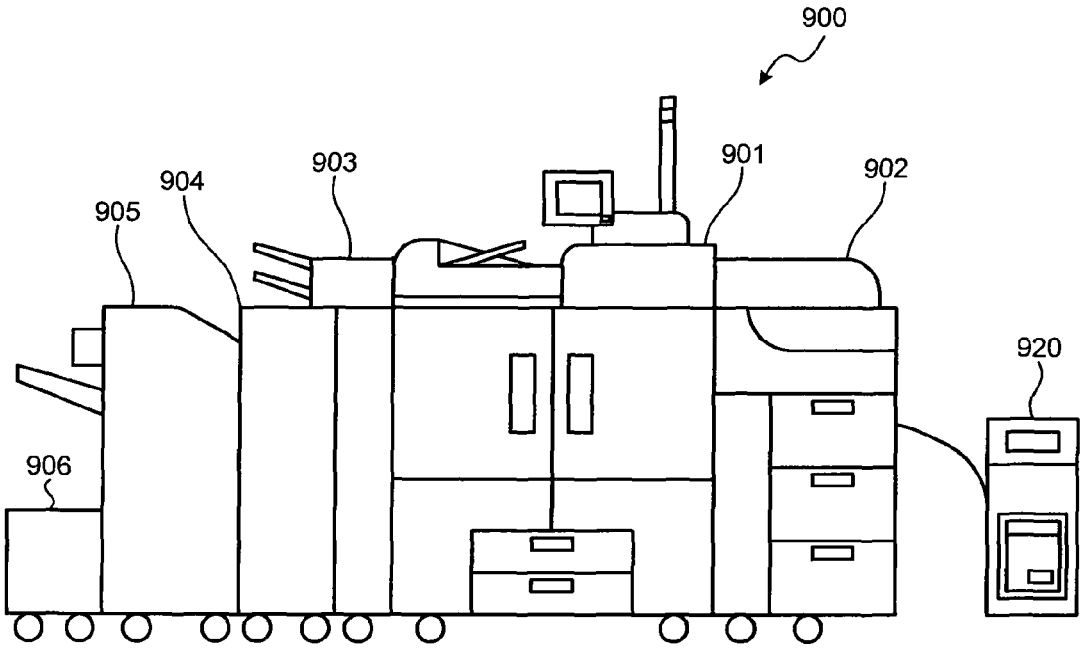
FIG. 19 is an external view of an example of a printing system according to an eleventh modification.

FIG. 19 is an external view of an example of a printing system 900 according to an eleventh modification. The printing system 900 is a production printing machine and includes a server apparatus 920. The server apparatus 920 is, for example, an external server or an external controller called a digital front end (DFE). In the printing system 900, peripheral devices, such as a large-capacity sheet feed unit 902 for feeding sheets, an inserter 903 used for a cover sheet or the like, a folding unit 904 for folding a sheet, a finisher 905 for stapling or punching, and a cutting machine 906 for cutting sheets, are combined with a printing apparatus 901 as needed basis.

Figure 20:
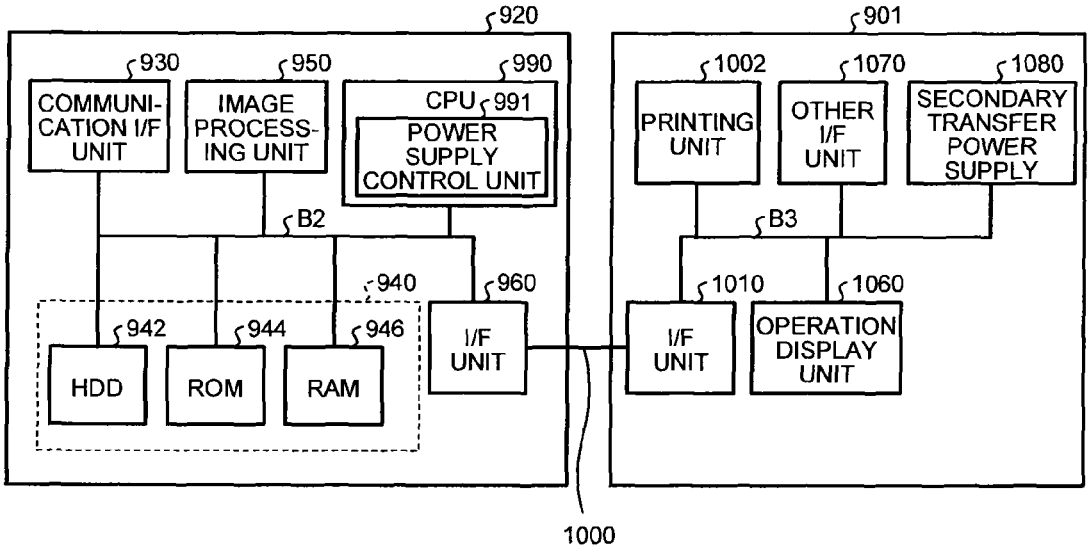
FIG. 20 is a hardware configuration diagram of an example of a server apparatus according to the eleventh modification.

FIG. 20 is a hardware configuration diagram of an example of the server apparatus 920 according to the eleventh modification. As illustrated in FIG. 20, the server apparatus 920 includes a communication I/F unit 930, a storage unit 940 (a HDD 942, a ROM 944, and a RAM 946), an image processing unit 950, a CPU 990, and an I/F unit 960, which are connected to one another via a bus $B_2$. The CPU 990 includes a power supply control unit 991.

In the example in FIG. 20, the server apparatus 920 is connected to the printing apparatus 901 via a dedicated line 1000. However, a connection form of the server apparatus 920 and the printing apparatus 901 is not limited to this configuration. For example, the server apparatus 920 and the printing apparatus 901 may be connected via a network as long as a necessary communication speed can be secured between the server apparatus 920 and the printing apparatus 901.

As illustrated in FIG. 20, the printing apparatus 901 includes an I/F unit 1010, a printing unit 1002, an operation display unit 1060, an other I/F unit 1070, and a secondary transfer power supply 1080, which are connected to one another via a bus $B_3$. The I/F unit 1010 is a means for connecting the printing apparatus 901 to the server apparatus 920. The leased line 1000 is connected to the I/F unit 1010. The printing apparatus 901 executes a print job under the control of the CPU 990 of the server apparatus 920.

The power supply control unit 991 included in the server apparatus 920 executes processes executed by the power supply control unit of the printing apparatus of the above embodiments.

Twelfth Modification

The above-described embodiments and modifications are described by way of example only. It has been confirmed by using other image forming apparatuses or various image formation environments that the present invention can be realized with modified configurations or modified process conditions.

According to the embodiments, it is possible to reduce density deviation or density reduction of an image even when a voltage used for transferring the image onto a recording medium is changed depending on a recording medium.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a transfer unit configured to transfer a toner image onto a recording medium;

a power supply unit configured to apply one of a superimposed voltage in which an alternating-current voltage and a first direct-current voltage are superimposed and a second direct-current voltage to the transfer unit; and a power supply control unit configured to, when the power supply unit outputs the superimposed voltage, instruct the power supply unit to output the first direct-current voltage at a first timing relative to a reference timing for print start, and when the power-supply unit outputs the second direct-current voltage, instruct the power-supply unit to output the second direct-current voltage at a second timing relative to the reference timing for print start, the second timing being further from the reference timing for print start than the first timing.

2. The image forming apparatus according to claim 1, wherein when the power supply unit outputs the superimposed voltage, the power supply control unit instructs the power supply unit to output the alternating-current voltage at approximately a same timing as the first timing.

3. The image forming apparatus according to claim 1, further comprising a storage unit configured to store therein designation information designating the first timing or the second timing and interval information indicating an interval between the first timing and the second timing, wherein the power supply control unit causes the power supply unit to start outputting the first alternating-current voltage at the first timing and causes the power supply control unit to start outputting the second direct-current voltage at the second timing, on the basis of the designation information and the interval information.

4. The image forming apparatus according to claim 3, wherein the designation information designates at least one of the first timing and the second timing with reference to the reference timing for print start.

5. The image forming apparatus according to claim 1, further comprising a storage unit configured to store therein designation information designating the first timing and the second timing, wherein the power supply control unit causes the power supply unit to start outputting the first direct-current voltage at the first timing and causes the power supply unit to start outputting the second direct-current voltage at the second timing, on the basis of the designation information.

6. The image forming apparatus according to claim 5, wherein the designation information designates at least one of the first timing and the second timing with reference to the reference timing for print start.

7. The image forming apparatus according to claim 1, wherein when the power supply unit outputs the superimposed voltage, the power supply control unit instructs the power supply unit to output the alternating-current voltage at a third timing which is later than the first timing.

8. The image forming apparatus according to claim 7, further comprising a storage unit configured to store therein designation information designating the first timing and interval information indicating an interval between the first timing and the second timing and an interval between the first timing and the third timing, wherein the power supply control unit causes the power supply unit to start outputting the first direct-current voltage at the first timing, causes the power supply unit to start outputting the alternating-current voltage at the third timing, and causes the power supply unit to start outputting the second direct-current voltage at the second timing, on the basis of the designation information and the interval information.

9. The image forming apparatus according to claim 8, wherein the designation information designates at least one of the first timing, the second timing, and the third timing with reference to a print start reference signal.

10. The image forming apparatus according to claim 7, further comprising a storage unit configured to store therein designation information designating the first timing, the second timing, and the third timing, wherein the power supply control unit causes the power supply unit to output the first direct-current voltage at the first timing, causes the power supply unit to output the alternating-current voltage at the third timing, and causes the power supply unit to output the second direct-current voltage at the second timing, on the basis of the designation information.

11. The image forming apparatus according to claim 10, wherein the designation information designates at least one of the first timing, the second timing, and the third timing with reference to a print start reference signal.

12. An image forming system comprising:

an image forming apparatus including a transfer unit configured to transfer a toner image onto a recording medium, and a power supply unit configured to apply one of a superimposed voltage in which an alternating-current voltage and a first direct-current voltage are superimposed and a second direct-current voltage to the transfer unit; and a power supply control unit configured to, when the power supply unit outputs the superimposed voltage, instruct the power supply unit to output at least the first direct-current voltage at a first timing relative to a reference timing for print start, and when the power supply unit outputs the second direct-current voltage, instruct the power supply unit to output the second direct-current voltage at a second timing relative to the reference timing for print start, the second timing being further from the reference timing for print start than the first timing.

13. A transfer method comprising:

transferring, by a transfer unit, a toner image onto a recording medium;

applying, by a power supply unit, one of a superimposed voltage in which an alternating-current voltage and a first direct-current voltage are superimposed and a second direct-current voltage to the transfer unit;

instructing, by a power supply control unit, the power supply unit to start outputting at least the first direct-current voltage at a first timing relative to a reference timing for print start, when the superimposed voltage is output at the applying; and instructing, by the power supply control unit, the power supply unit to start outputting the second direct-current voltage at a second timing relative to the reference timing for print start when the second direct-current voltage is output at the applying, the second timing being further from the reference timing for print start than the first timing.

14. The image forming apparatus according to claim 1, wherein the reference timing for print start is a time at which a print start reference signal is received.

15. The image forming apparatus according to claim 1, wherein the transfer unit includes an image carrier and a roller, a nip is formed by the image carrier and the roller, and a toner image is transferred at the nip from the image carrier to a recording medium that is conveyed.

* * * * *